US008706479B2

(12) United States Patent
Zopf et al.

(10) Patent No.: US 8,706,479 B2
(45) Date of Patent: Apr. 22, 2014

(54) PACKET LOSS CONCEALMENT FOR SUB-BAND CODECS

(75) Inventors: Robert W. Zopf, Rancho Santa Margarita, CA (US); Laurent Pilati, Antibes (FR)

(73) Assignee: Broadcom Corporation, Irvine, CA (US)

( * ) Notice: Subject to any disclaimer, the term of this patent is extended or adjusted under 35 U.S.C. 154(b) by 1171 days.

(21) Appl. No.: 12/614,153

(22) Filed: Nov. 6, 2009

(65) Prior Publication Data

US 2010/0125454 A1 May 20, 2010

Related U.S. Application Data

(60) Provisional application No. 61/114,864, filed on Nov. 14, 2008.

(51) Int. Cl.
*G10L 19/00* (2013.01)

(52) U.S. Cl.
USPC ..... 704/219

(58) Field of Classification Search
USPC ..... 704/219
See application file for complete search history.

(56) References Cited

U.S. PATENT DOCUMENTS

| | | | | |
|---|---|---|---|---|
| 5,884,010 | A * | 3/1999 | Chen et al. | 704/228 |
| 7,047,187 | B2 * | 5/2006 | Cheng et al. | 704/219 |
| 7,206,740 | B2 * | 4/2007 | Thyssen et al. | 704/222 |
| 7,272,554 | B2 * | 9/2007 | Serizawa et al. | 704/219 |
| 7,877,253 | B2 * | 1/2011 | Krishnan et al. | 704/225 |
| 8,255,207 | B2 * | 8/2012 | Vaillancourt et al. | 704/219 |
| 2002/0101369 | A1 * | 8/2002 | Gottesman | 341/94 |
| 2003/0009325 | A1 * | 1/2003 | Kirchherr et al. | 704/211 |
| 2003/0055632 | A1 * | 3/2003 | Chen | 704/219 |
| 2003/0074197 | A1 * | 4/2003 | Chen | 704/262 |
| 2003/0135367 | A1 * | 7/2003 | Thyssen et al. | 704/230 |
| 2003/0200083 | A1 * | 10/2003 | Serizawa et al. | 704/219 |
| 2005/0154584 | A1 * | 7/2005 | Jelinek et al. | 704/219 |
| 2006/0184861 | A1 * | 8/2006 | Sun et al. | 714/776 |
| 2006/0265216 | A1 * | 11/2006 | Chen | 704/228 |
| 2006/0271357 | A1 * | 11/2006 | Wang et al. | 704/223 |
| 2006/0271373 | A1 * | 11/2006 | Khalil et al. | 704/500 |
| 2007/0174047 | A1 * | 7/2007 | Anderson et al. | 704/207 |
| 2008/0249766 | A1 * | 10/2008 | Ehara | 704/203 |
| 2008/0319740 | A1 * | 12/2008 | Su et al. | 704/225 |
| 2009/0006084 | A1 | 1/2009 | Chen | |
| 2009/0076808 | A1 * | 3/2009 | Xu et al. | 704/207 |
| 2009/0119098 | A1 * | 5/2009 | Zhan et al. | 704/219 |
| 2010/0318349 | A1 * | 12/2010 | Kovesi et al. | 704/207 |
| 2011/0196673 | A1 * | 8/2011 | Sharma et al. | 704/207 |

OTHER PUBLICATIONS

Shetty et al. "Packet Loss Concealment for G.722 using Side Information with Application to Voice over Wireless LANs" 2007.*
Thyssen et al. "A Candidate for the ITU-T G.722 Packet Loss Concealment Standard" 2007.*

(Continued)

*Primary Examiner* — Michael N Opsasnick
(74) *Attorney, Agent, or Firm* — Fiala & Weaver P.L.L.C.

(57) ABSTRACT

Packet loss concealment systems and methods are described that may be used in conjunction with a Bluetooth® Low-Complexity Sub-band Coding (LC-SBC) codec or other sub-band codecs, including but not limited to an MPEG-1 Audio Layer 3 (MP3) codec, an Advanced Audio Coding (AAC) codec, and a Dolby AC-3 codec.

20 Claims, 17 Drawing Sheets

(56) References Cited

OTHER PUBLICATIONS

Thyssen et al. "Detailed description of the Broadcom G.722 PLC candidate algorithm" 2006.*
Serizawa et al. "Packet Loss Concealment Method Using Pitch Waveform Repetition and Internal State Update on the Decoded Speech for the Sub-Band ADPCM Wideband Speech Codec" 2002.*
ITU-T G.722 "Appendix IV: A low-complexity algorithm for packet loss concealment with G.722" 2007.*
Kovesi et al. "A Low Complexity Packet Loss Concealment Algorithm for ITU-T G.722" 2008.*
Hiwasaki et al. "A Wideband Speech and Audio Coding Candidate for ITU-T G.711WBE Standardization" 2008.*
ITU-T G.722 "Appendix III: A high-quality packet loss concealment algorithm for G.722" 2006.*
Advanced Audio Distribution Profile Specification, Bluetooth Doc, Document No. A2DP_SPEC, Prepared by Audio Video WG, Apr. 16, 2007, 71 pages.

* cited by examiner

300

PACKET LOSS CONCEALMENT FOR SUB-BAND CODECS

CROSS-REFERENCE TO RELATED APPLICATIONS

This application claims priority to U.S. Provisional Patent Application No. 61/114,864 filed Nov. 14, 2008, the entirety of which is incorporated by reference herein.

BACKGROUND OF THE INVENTION

1. Field of the Invention

The present invention relates to digital communication systems. More particularly, the present invention relates to the enhancement of speech quality when portions of an encoded bit stream representing a speech signal are lost within the context of a digital communications system.

2. Background

In speech coding (sometimes called "voice compression"), a coder encodes an input speech signal into a digital bit stream for transmission. A decoder decodes the bit stream into an output speech signal. The combination of the coder and the decoder is called a codec. The transmitted bit stream is usually partitioned into segments called frames, and in packet transmission networks, each transmitted packet may contain one or more frames of a compressed bit stream. In wireless or packet networks, sometimes the transmitted frames or packets are erased or lost. This condition is typically called frame erasure in wireless networks and packet loss in packet networks. When this condition occurs, to avoid substantial degradation in output speech quality, the decoder needs to perform frame erasure concealment (FEC) or packet loss concealment (PLC) to try to conceal the quality-degrading effects of the lost frames. Because the terms FEC and PLC generally refer to the same kind of technique, they can be used interchangeably. Thus, for the sake of convenience, the term "packet loss concealment," or PLC, is used herein to refer to both.

Today, a growing and popular wireless communications protocol being deployed is Bluetooth®, an industrial specification for wireless personal area networks (PANs). Bluetooth® provides a way to connect and exchange information between devices such as mobile phones, laptops, personal computers, printers, headsets, etc. over a secure, globally unlicensed short-range radio frequency.

On the Bluetooth® air-interface, a 64 kilobit/second (kb/s) log pulse code modulation (PCM) format (A-law or u-law) or a 64 kb/s Continuously Variable Slope Delta (CVSD) modulation format may be used for narrowband (8 kilohertz (kHz) sampling rate) speech signals. For higher sampling rates (e.g., 16, 32, or 44 kHz), the Low-Complexity Sub-band Codec (LC-SBC) may be used. LC-SBC is an audio coding system specially designed for Bluetooth® audio applications to obtain high quality audio at medium bit rates, and having a low computational complexity. As cellular telephone communication evolves to wideband speech, Bluetooth® headsets must also support wideband speech. LC-SBC is currently a mandatory codec in supporting wideband speech, but there is no PLC specification for LC-SBC.

BRIEF SUMMARY OF THE INVENTION

Packet loss concealment systems and methods are described herein that may advantageously be used in conjunction with the Low-Complexity Sub-band Codec (LC-SBC) designed for Bluetooth® audio applications or other sub-band codecs, including but not limited to the MPEG-1 Audio Layer 3 (MP3) codec, the Advanced Audio Coding (AAC) codec and the Dolby AC-3 codec.

Further features and advantages of the invention, as well as the structure and operation of various embodiments of the invention, are described in detail below with reference to the accompanying drawings. It is noted that the invention is not limited to the specific embodiments described herein. Such embodiments are presented herein for illustrative purposes only. Additional embodiments will be apparent to persons skilled in the relevant art(s) based on the teachings contained herein.

BRIEF DESCRIPTION OF THE DRAWINGS/FIGURES

The accompanying drawings, which are incorporated herein and form part of the specification, illustrate the present invention and, together with the description, further serve to explain the principles of the invention and to enable a person skilled in the relevant art(s) to make and use the invention.

Figure 1:
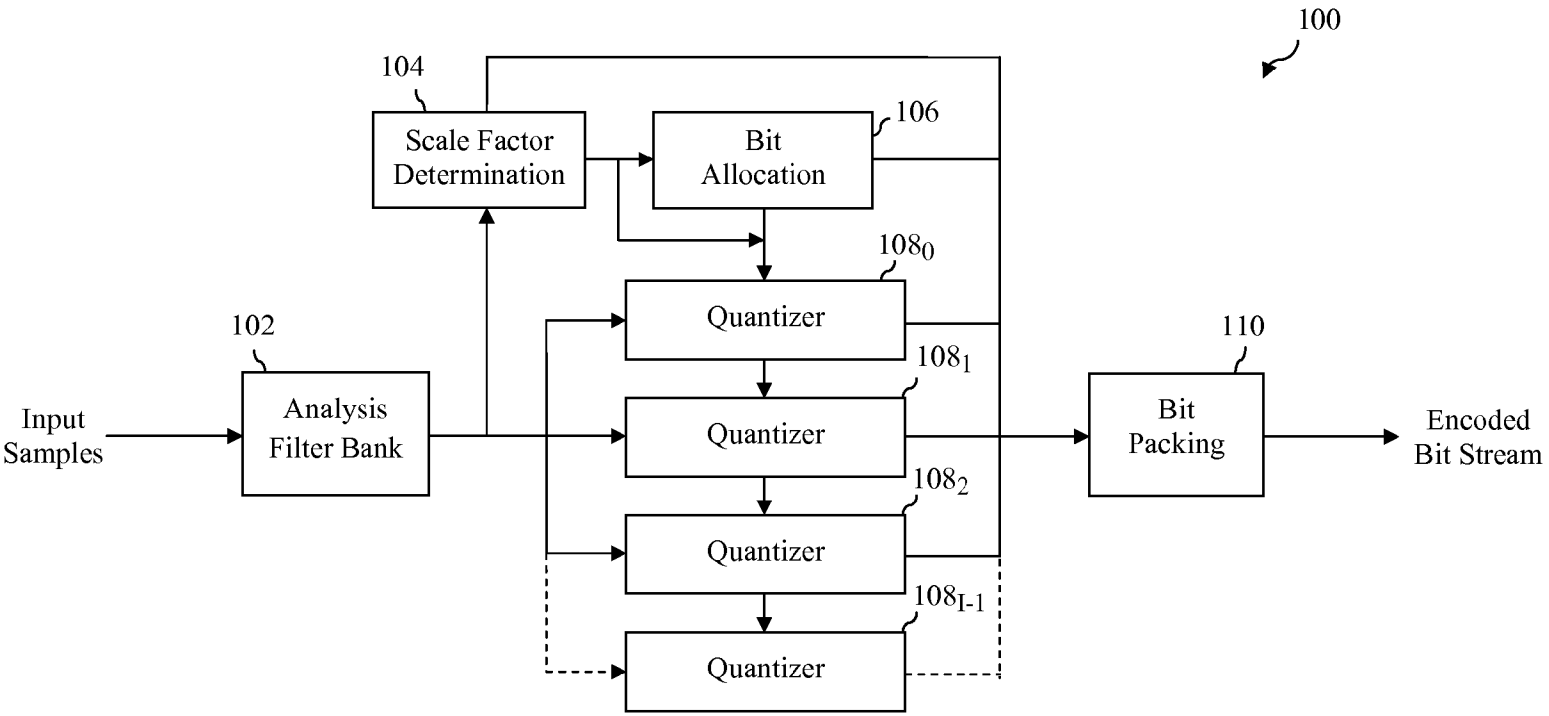
FIG. 1 (Prior Art)
FIG. 1 is a block diagram of a conventional Low-Complexity Sub-band Coding (LC-SBC) encoder.

The features and advantages of the present invention will become more apparent from the detailed description set forth below when taken in conjunction with the drawings, in which like reference characters identify corresponding elements throughout. In the drawings, like reference numbers generally indicate identical, functionally similar, and/or structurally similar elements. The drawing in which an element first appears is indicated by the leftmost digit(s) in the corresponding reference number.

DETAILED DESCRIPTION OF THE INVENTION

A. Introduction

The following detailed description of the present invention refers to the accompanying drawings that illustrate exemplary embodiments consistent with this invention. Other embodiments are possible, and modifications may be made to the embodiments within the spirit and scope of the present invention. Therefore, the following detailed description is not meant to limit the invention. Rather, the scope of the invention is defined by the appended claims.

References in the specification to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to implement such feature, structure, or characteristic in connection with other embodiments whether or not explicitly described.

Packet loss concealment (PLC) systems and methods for sub-band speech codecs are described herein. For illustrative purposes, the PLC systems and methods will be described in reference to the Bluetooth® Low-Complexity Sub-band Codec (LC-SBC). However, the systems and methods described herein can also be used in conjunction with other sub-band codecs, including but not limited to the MPEG-1 Audio Layer 3 (MP3) codec, the Advanced Audio Coding (AAC) codec and the Dolby AC-3 codec. As used herein, the term "sub-band codec" generally refers to any codec that decomposes a full-band audio signal up into a number of different frequency sub-bands and encodes each one independently. Any modifications or adaptations necessary for using the systems and methods described herein in conjunction with such other sub-band codecs will be well within the capabilities of persons skilled in the relevant art(s).

B. Low-Complexity Sub-Band Codec (LC-SBC)

Before describing PLC systems and methods in accordance with embodiments of the present invention, a brief description of LC-SBC will be provided. LC-SBC is premised on an audio coding framework that was first proposed by F. de Bont et al. in "A High Quality Audio-Coding System at 128 kb/s", 98$^{th}$ AES Convention, Feb. 25-28, 1995. The audio coding framework was proposed as a simple low-delay solution for a growing number of mobile audio applications. The Bluetooth® standardization body adopted a low-complexity version of this codec as the mandatory codec for the Advanced Audio Distribution Profile (A2DP), and more recently as the mandatory codec for wideband speech communication. For the remainder of this application, this codec will be referred to as the Low-Complexity Sub-band Codec (LC-SBC). LC-SBC is a transform-based codec that relies on 4 or 8 uniformly spaced sub-bands, with adaptive block pulse code modulation (PCM) quantization and an adaptive bit-allocation algorithm. The technical specification of LC-SBC is given in "Advanced Audio Distribution Profile Specification," Appendix B, Bluetooth Audio Video Working Group, Revision V12, Apr. 16, 2007, the entirety of which is incorporated by reference herein.

FIG. 1 is a block diagram of a conventional LC-SBC encoder 100. As shown in FIG. 1, LC-SBC encoder 100 includes an analysis filter bank 102, a scale factor determination module 104, a bit allocation module 106, a plurality of quantizers $\mathbf{108}_0$-$\mathbf{108}_{I-1}$ and a bit packing module 110. LC-SBC encoder 100 is configured to operate on a frame of input samples, wherein a frame comprises a configurable number of blocks of I pulse code modulated (PCM) input samples and wherein I represents the number of sub-bands. The number of sub-bands may be 4 or 8 depending upon the implementation.

Figure 2:
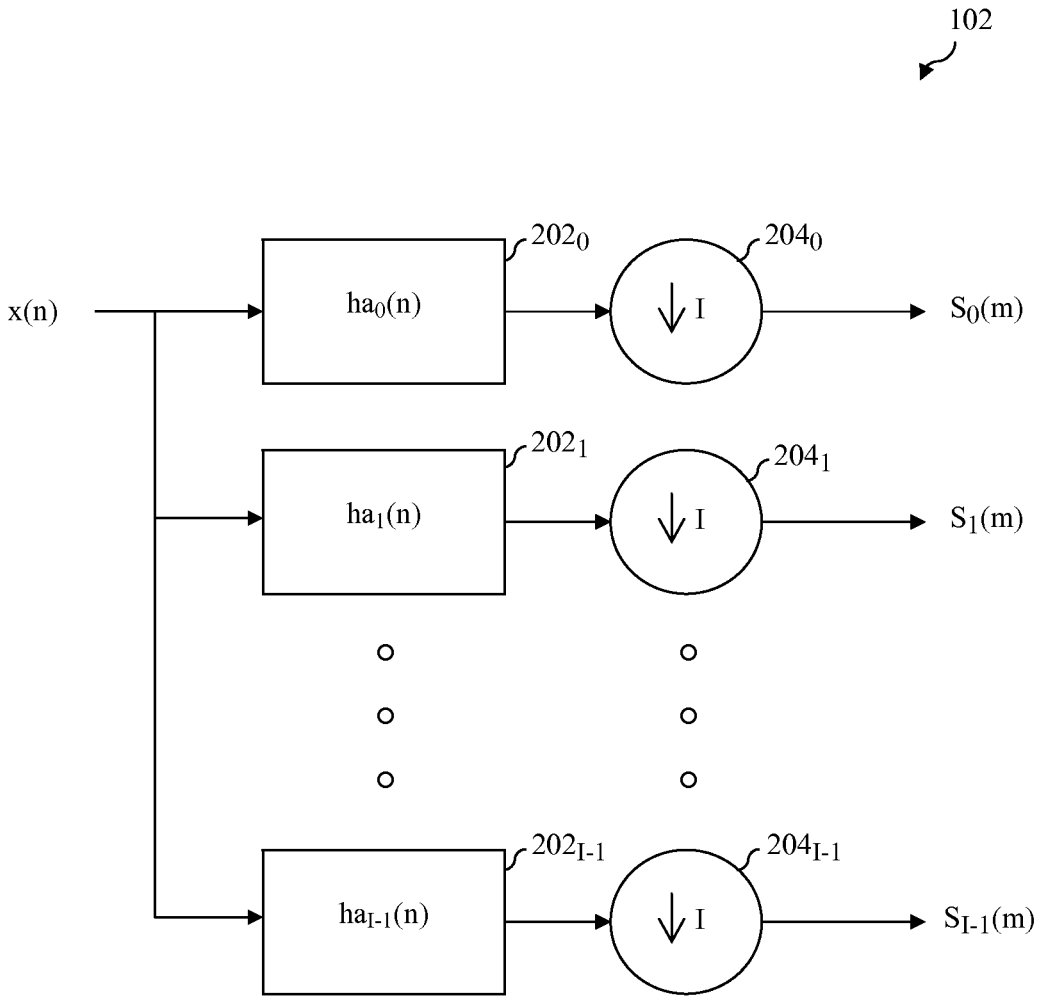
FIG. 2 is a block diagram of an analysis filter bank for an LC-SBC encoder.
Figure 3:
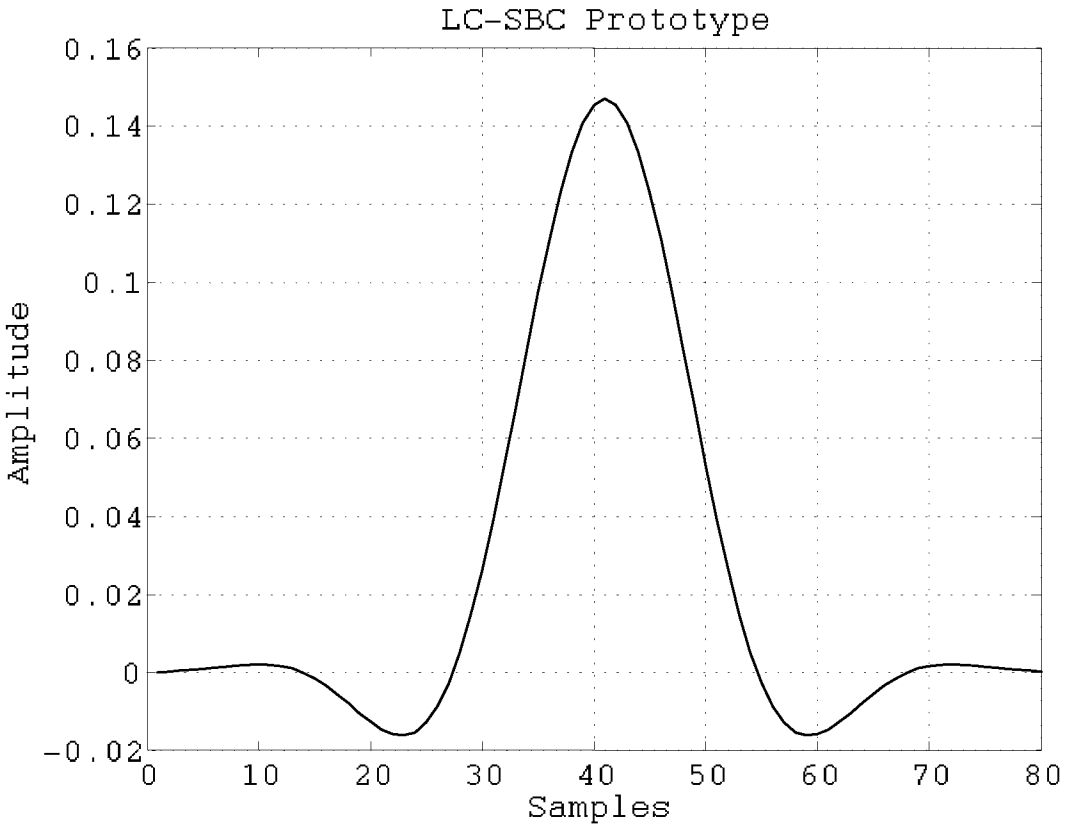
FIG. 3 depicts a prototype filter used to obtain band-pass analysis filters for use in an LC-SBC encoder and band-pass synthesis filters for use in an LC-SBC decoder.

FIG. 2 is a block diagram of analysis filter bank 102. Analysis filter bank 102 receives an audio signal represented by a series of input samples, denoted x(n), and decomposes the audio signal into a set of sub-band signals, denoted $S_0(m)$-$S_{I-1}(m)$. Analysis filter bank 102 is implemented in part by means of a bank of cosine-modulated analysis filters $\mathbf{202}_0$-$\mathbf{202}_{I-1}$. A prototype filter is used to generate the individual analysis filters in accordance with equation (1):

$$ha_i[n] = p[n]\cos\left[\left(i+\frac{1}{2}\right)\left(n-\frac{I}{2}\right)\frac{\pi}{I}\right],\ n = 0, \ldots, L-1 \tag{1}$$

wherein L represents the filter length and is equal to 10*I, p[n] is the prototype filter, and $ha_i$ is the analysis filter for sub-band i, i=0, . . . , I−1. FIG. 3 depicts a graph 300 that shows the impulse response of the prototype filter p[n] for an eight sub-band implementation.

As shown in FIG. 2, the signal that is output by each analysis filter $\mathbf{202}_0$-$\mathbf{202}_{I-1}$ is received by a corresponding downsampler $\mathbf{204}_0$-$\mathbf{204}_{I-1}$ and downsampled by a factor of I. As a result, for every block of I samples of full-band audio signal x(n) processed, analysis filter bank 102 produces a single sample of each sub-band signal $S_0(m)$-$S_{I-1}(m)$. In the specification for LC-SBC, the application of the analysis filters and the downsampling is combined into a single LC-SBC analysis algorithm.

After analysis filter bank 102 has generated a sample of each sub-band signal $S_0(m)$-$S_{I-1}(m)$ for each block of samples of audio signal x(n) in a frame, scale factor determination module 104 determines a scale factor for each sub-band. The scale factor for a given sub-band is the largest absolute value of any sample in that sub-band. Bit allocation module 106 then determines a number of bits to be allocated to each sub-band. Bit allocation module 106 may use one of two processes to perform this function depending upon the configuration. One process attempts to improve the ratio between the audio signal and the quantization noise, while the other accounts for human auditory sensitivity. Both processes rely on the scale factor associated with each sub-band and the location of the sub-band to determine how many bits should be dedicated to each sub-band. Regardless of which process is used, bit allocation module 106 generally allocates larger numbers of bits to lower-frequency sub-bands having larger scale factors.

Each of quantizers $\mathbf{108}_0$-$\mathbf{108}_{I-1}$ receives the set of samples corresponding to each sub-band signal $S_0(m)$-$S_{I-1}(m)$ from analysis filter bank 102, the scale factor associated with each sub-band from scale factor determination module 104, and the number of bits to be allocated to each sub-band from bit allocation module 106. Each of quantizers $\mathbf{108}_0$-$\mathbf{108}_{I-1}$ quantizes the scale factor by taking the next higher powers of 2. Each of quantizers $\mathbf{108}_0$-$\mathbf{108}_{I-1}$ then normalizes the sub-band samples by the quantized scale factor. Then each of quantizers $\mathbf{108}_0$-$\mathbf{108}_{I-1}$ quantizes the normalized blocks of sub-band samples in accordance with equation (2):

$$\overline{S_i}[m] = \left(\frac{\hat{S}_i[m]}{2^{SCF_i}} + 1\right)\left(\frac{2^{B_i}}{2}\right) \tag{2}$$

wherein $\overline{S}_i[m]$ and $\hat{S}_i[m]$ represent the quantized and original normalized sub-band sample m from sub-band i, i=0, . . . , I−1. The quantized scale factor for sub-band i and the number of bits allocated to it are represented by $SCF_i$ and $B_i$, respectively.

Bit packing module 110 receives bits representative of the quantized scale factors and quantized sub-band samples from each of quantizers $\mathbf{108}_0$-$\mathbf{108}_{I-1}$ and arranges the bits in a manner suitable for transmission to an LC-SBC decoder.

Figure 4:
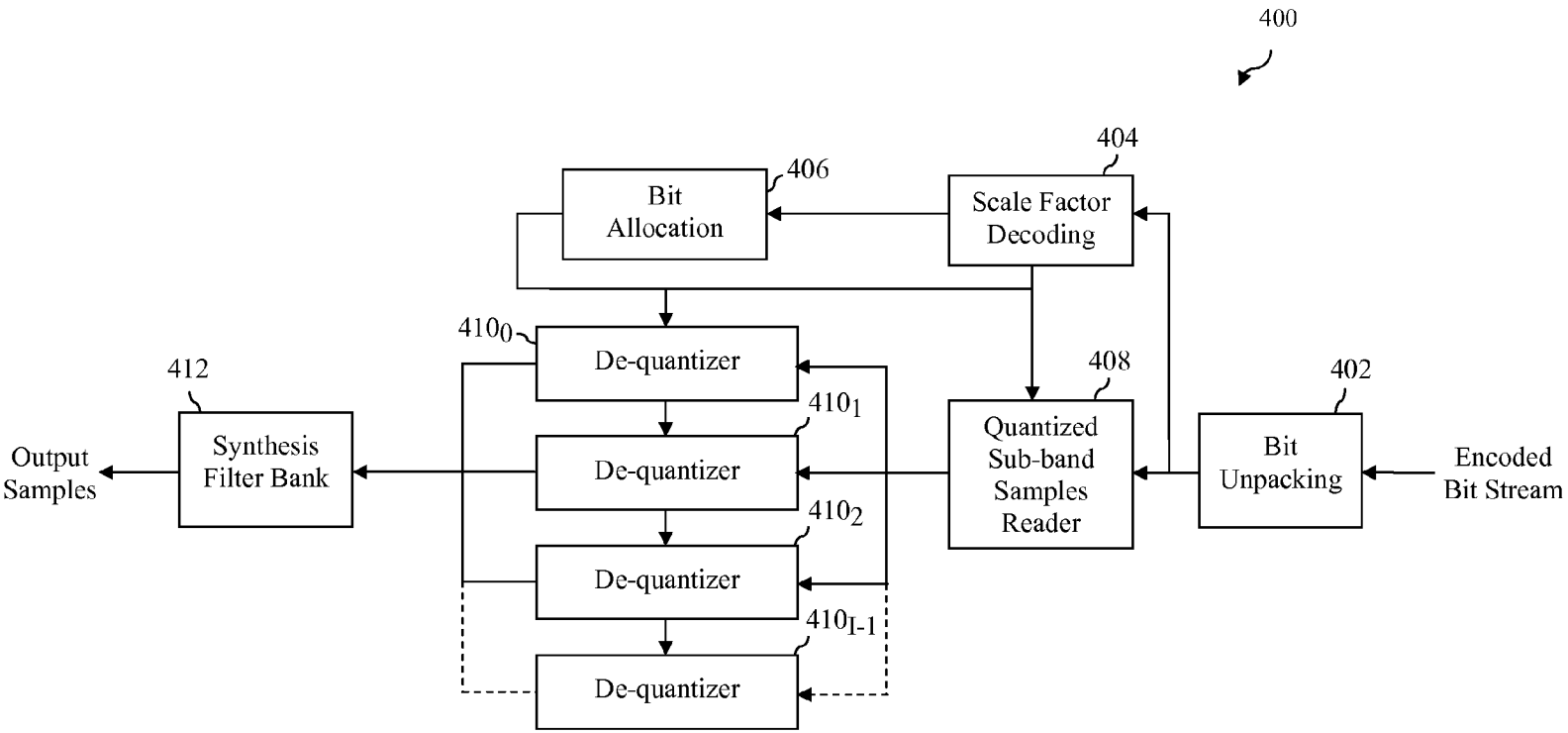
FIG. 4 (Prior Art)
FIG. 4 is a block diagram of a conventional LC-SBC decoder.

FIG. 4 is a block diagram of a conventional LC-SBC decoder 400. As shown in FIG. 4, LC-SBC decoder 400 includes a bit unpacking module 402, a scale factor decoding module 404, a bit allocation module 406, a quantized sub-band samples reader 408, a plurality of de-quantizers $\mathbf{410}_0$-$\mathbf{410}_{I-1}$ and a synthesis filter bank 412.

Bit unpacking module 402 receives an encoded bit stream representative of a frame of an audio signal from an LC-SBC encoder (such as LC-SBC encoder 100), from which it extracts bits representative of quantized scale factors and quantized sub-band samples.

Scale factor decoding module 404 receives the quantized scale factors from bit unpacking module 402 and de-quantizes the quantized scale factors to produce a scale factor for each of 4 or 8 sub-bands, depending upon the implementation. Bit allocation module 406 receives the scale factors from scale factor decoding module 404 and operates in a like manner to bit allocation module 106 of LC-SBC encoder 100 to determine a number of bits to be allocated to each sub-band based on the scale factors and the locations of the sub-bands.

Quantized sub-band samples reader 408 Receives the number of bits to be allocated to each sub-band from bit allocation module 406 and uses this information to properly extract quantized sub-band samples associated with each sub-band from bits provided by bit unpacking module 402.

Each of de-quantizers $\mathbf{410}_0$-$\mathbf{410}_{I-1}$ receives a number of quantized sub-band samples corresponding to a particular sub-band from quantized sub-band samples reader 408, a quantized scale factor associated with the particular sub-band from bit unpacking module 402, and a number of bits to be allocated to the particular sub-band from bit allocation module 406. Using this information, each of de-quantizers $\mathbf{410}_0$-$\mathbf{410}_{I-1}$ operates in an inverse manner to quantizers $\mathbf{108}_0$-$\mathbf{108}_{I-1}$ described above in reference to LC-SBC encoder 100 to produce a number of de-quantized sub-band samples for each sub-band. A single de-quantized sub-band sample is produced for each block in the frame being decoded.

Figure 5:
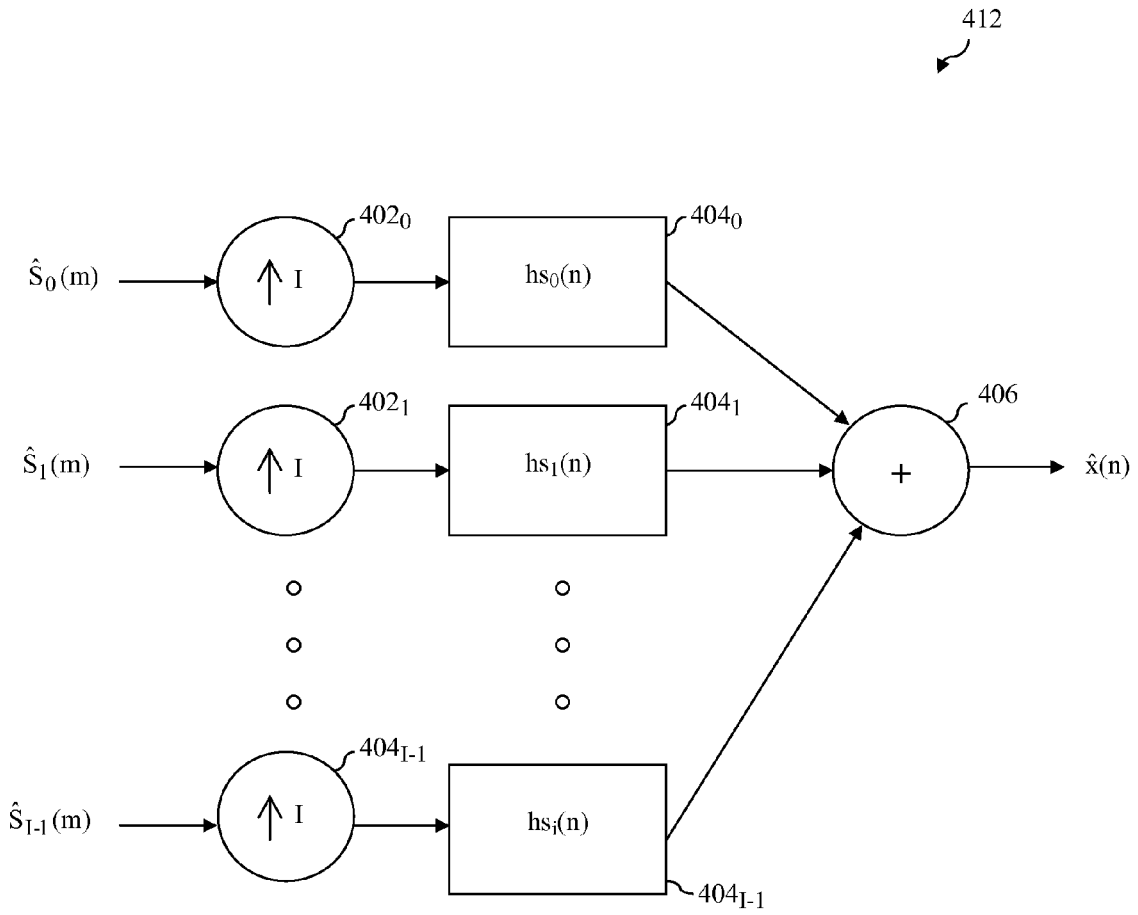
FIG. 5 is a block diagram of a synthesis filter bank for an LC-SBC encoder.

Synthesis filter bank 412 receives the de-quantized sub-band samples from each of de-quantizers $\mathbf{410}_0$-$\mathbf{410}_{I-1}$ and combines them to produce a frame of output samples representative of the original audio signal. FIG. 5 is a block diagram of synthesis filter bank 412. As shown in FIG. 5, synthesis filter bank 412 is implemented in part by means of a bank of cosine-modulated synthesis filters $\mathbf{404}_0$-$\mathbf{404}_{I-1}$. A prototype filter is used to generate the individual synthesis filters in accordance with equation (3):

$$hs_i[n] = p[n]\cos\left[\left(i + \frac{1}{2}\right)\left(n + \frac{I}{2}\right)\frac{\pi}{I}\right],\ n = 0, \ldots, L-1 \tag{3}$$

wherein L represents the filter length and is equal to 10*I, p[n] is the prototype filter described above (the impulse response of which is shown in FIG. 3 for an eight sub-band implementation), and $hs_i$ is the synthesis filter for sub-band i, i=0, . . . , I−1.

As shown in FIG. 5, the de-quantized sub-band samples received from each of de-quantizers $\mathbf{410}_0$-$\mathbf{410}_{I-1}$ may be represented as signals $\hat{S}_0(m)$-$\hat{S}_{I-1}(m)$. Each of these signals is received by a corresponding upsampler $\mathbf{402}_0$-$\mathbf{402}_{I-1}$ and upsampled by a factor of I prior to being processed by a corresponding synthesis filter $\mathbf{404}_0$-$\mathbf{404}_{I-1}$. The upsampled and synthesis filtered signals are then combined by a combiner 406. By operating on a single sample of each sub-band in parallel, synthesis filter bank 412 produces a block of I samples of a full-band decoded audio signal $\hat{x}(n)$. In the specification for LC-SBC, the upsampling, the application of the synthesis filters and the combination of the upsampled and synthesis filtered signals is combined into a single LC-SBC synthesis algorithm.

C. Packet Loss Concealment for Sub-Band Codecs in Accordance with Embodiments of the Present Invention Various embodiments of the present invention that can be used to perform packet loss concealment (PLC) in conjunction with a sub-band codec such as LC-SBC will now be described. Where appropriate, advantages and disadvantages of each embodiment will be described.

In the following description, it will be assumed that the PLC systems and methods are being used in conjunction with an implementation of LC-SBC that has 8 sub-bands, an 8 millisecond (ms) frame size, and a bit rate of 62 kilobits per second (kbit/s) at a sampling rate of 16 kilohertz (kHz). Such an implementation will have 16 8-sample blocks per frame. This configuration is used for illustrative purposes only. Persons skilled in the relevant art(s) will appreciate that the PLC systems and methods described herein may also be implemented in conjunction with LC-SBC codecs having different configurations, or with other sub-band codecs entirely.

1. Full-Band Domain Based Packet Loss Concealment

Figure 6:
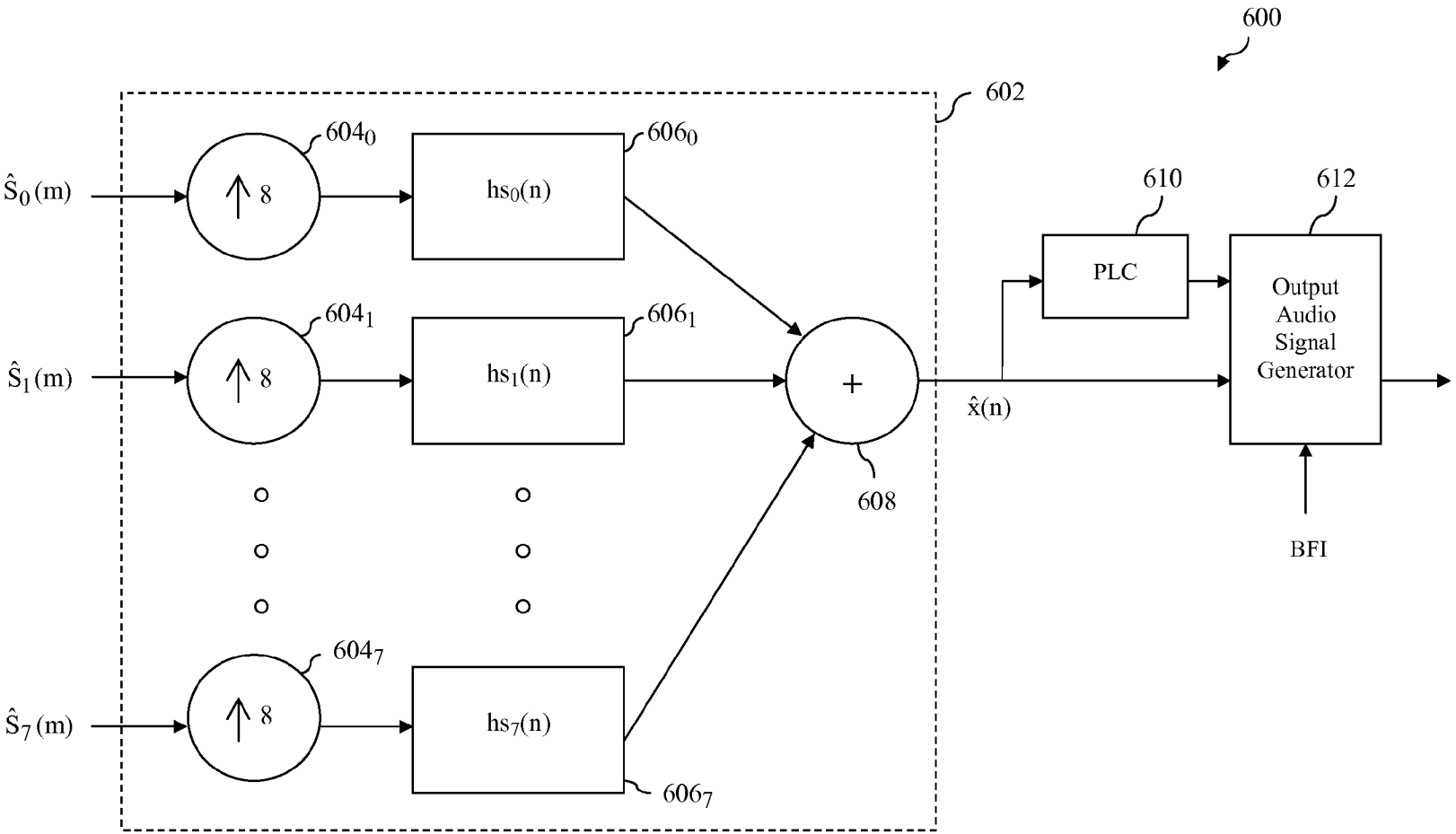
FIG. 6 is a block diagram of a system that implements a full-band domain based packet loss concealment (PLC) scheme in accordance with an embodiment of the present invention.

FIG. 6 is a block diagram of a system 600 that performs full-band domain based PLC in accordance with an embodiment of the present invention. As shown in FIG. 6, system 600 includes a synthesis filter bank 602 that comprises a plurality of upsamplers $\mathbf{604}_0$-$\mathbf{604}_7$, a plurality of synthesis filters $\mathbf{606}_0$-$\mathbf{606}_7$, and a combiner 608. Synthesis filter bank 602 operates on sub-band signals $\hat{S}_0(m)$-$\hat{S}_7(m)$ to produce a full-band audio signal $\hat{x}(n)$ in a like manner to synthesis filter bank 412 described above in reference to conventional LC-SBC decoder 400. System 600 further includes a PLC module 610 that uses the full-band audio signal $\hat{x}(n)$ as input to produce a full-band concealment signal in the presence of errors, as signaled by a bad frame indicator (BFI). An output audio signal generator 612 generates the system output signal by selectively switching between the full-band audio signal $\hat{x}(n)$ produced by synthesis filter bank 602 and the full-band concealment signal produced by PLC module 610 based on the state of the BFI. Note that in some embodiments, during the first good frame after a period of frame loss, output audio signal generator 612 generates a frame of the output audio signal by combining the full-band audio signal $\hat{x}(n)$ produced by synthesis filter bank 602 and a full-band concealment signal that was produced by PLC module 610 responsive to the frame loss.

The foregoing approach of system 600 has the advantage of using a single PLC module 610. PLC module 610 may employ known PLC techniques such as periodic waveform extrapolation (PWE) to generate the concealment signal based on the full-band signal $\hat{x}(n)$.

Figure 7:
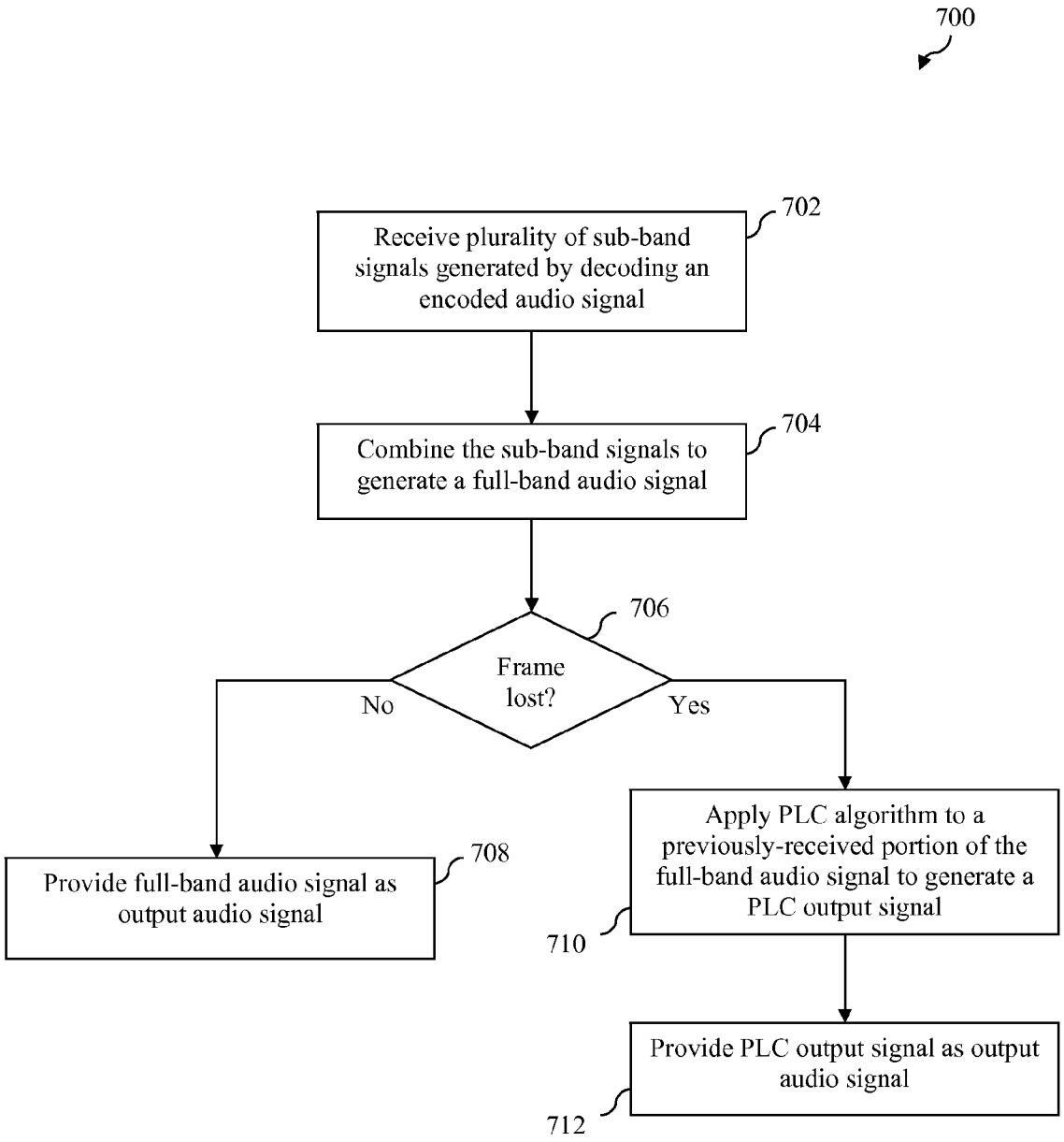
FIG. 7 depicts a flowchart of a method for performing full-band domain based PLC in accordance with an embodiment of the present invention.

FIG. 7 depicts a flowchart 700 of a method for performing full-band domain based PLC in accordance with an embodiment of the present invention. The method of flowchart 700 may be performed, for example, by system 600 of FIG. 6 although it is not limited to that embodiment.

As shown in FIG. 7, the method of flowchart 700 begins at step 702, in which a plurality of sub-band signals $\hat{S}_0(m)$-$\hat{S}_7(m)$ are received, wherein the plurality of sub-band signals were generated by decoding an encoded audio signal. Logic capable of generating these sub-band signals was previously described in reference to conventional LC-SBC decoder 400, as discussed above in reference to FIG. 4.

At step 704, the sub-band signals received at step 702 are combined to generate a full-band audio signal.

At decision step 706, it is determined whether a frame is lost. If it is determined at decision step 706 that the frame is not lost, then the full-band audio signal is provided as the output audio signal. However, if it is determined at decision step 706 that the frame is lost, then at step 710 a PLC algorithm is applied to a previously-received portion of the full-band audio signal to generate a PLC output signal. At step 712, the PLC output audio signal is provided as the output audio signal.

Note that in certain embodiments, if it is determined at decision step 706 that the frame is not lost and the frame is the first good frame after a period of frame loss, then the output audio signal is generated by combining the full-band audio signal with a previously-generated portion of the PLC output signal.

When using a full-band domain based PLC scheme such as that implemented by system 600 or described in reference to flowchart 700, the synthesis filter bank contains memory which must be handled appropriately during a bad frame. It can be seen from FIG. 3 that the prototype low-pass filter from which the synthesis filters are derived is of length 80 samples which equates to 5 ms at a 16 kHz sampling rate. As shown in FIG. 6, the synthesis filters are applied after 8:1 upsampling. Therefore, in each sub-band, there is a 10 sample buffer that accounts for 5 ms of samples at a 2 kHz sub-band sampling rate. During normal decoding, each sub-band sample is shifted into the respective buffer, one sample at a time, for the duration of the frame. Since a frame in the exemplary configuration of LC-SBC includes 16 blocks, this means 16 samples (m=0 . . . 15) will be shifted into each buffer, one sample at a time, for the duration of the frame. Hence, at the end of a frame, each buffer will contain the last 9 samples, $\hat{S}_i(m)$, m=7, . . . , 15, for use in the next frame. The last sample, $\hat{S}_i(15)$, will remain in the buffer for 9 sub-band samples, or 4.5 ms. In the full-band 16 kHz domain, this translates to 72 samples or, once again, 4.5 ms of memory in the synthesis filter bank.

During a frame loss, the sub-band samples $\hat{S}_i m$, m=7, . . . , 15 are not available, which means that the synthesis filter bank will require 4.5 ms for these missing samples to flush out of the buffers and for the output signal to completely re-converge with the true output signal. This can be seen in FIG. 8, which is a graph 800 comparing an input audio file with the output of an LC-SBC decoder in the presence of packet loss. In this example, the filter bank memory is left unchanged during the lost frame. It can be seen that if the filter memory is not handled appropriately, the effective length of the packet loss (including memory re-convergence effects) is up to 200 samples or 12.5 ms.

2. Sub-Band Domain Based Packet Loss Concealment

Figure 9:
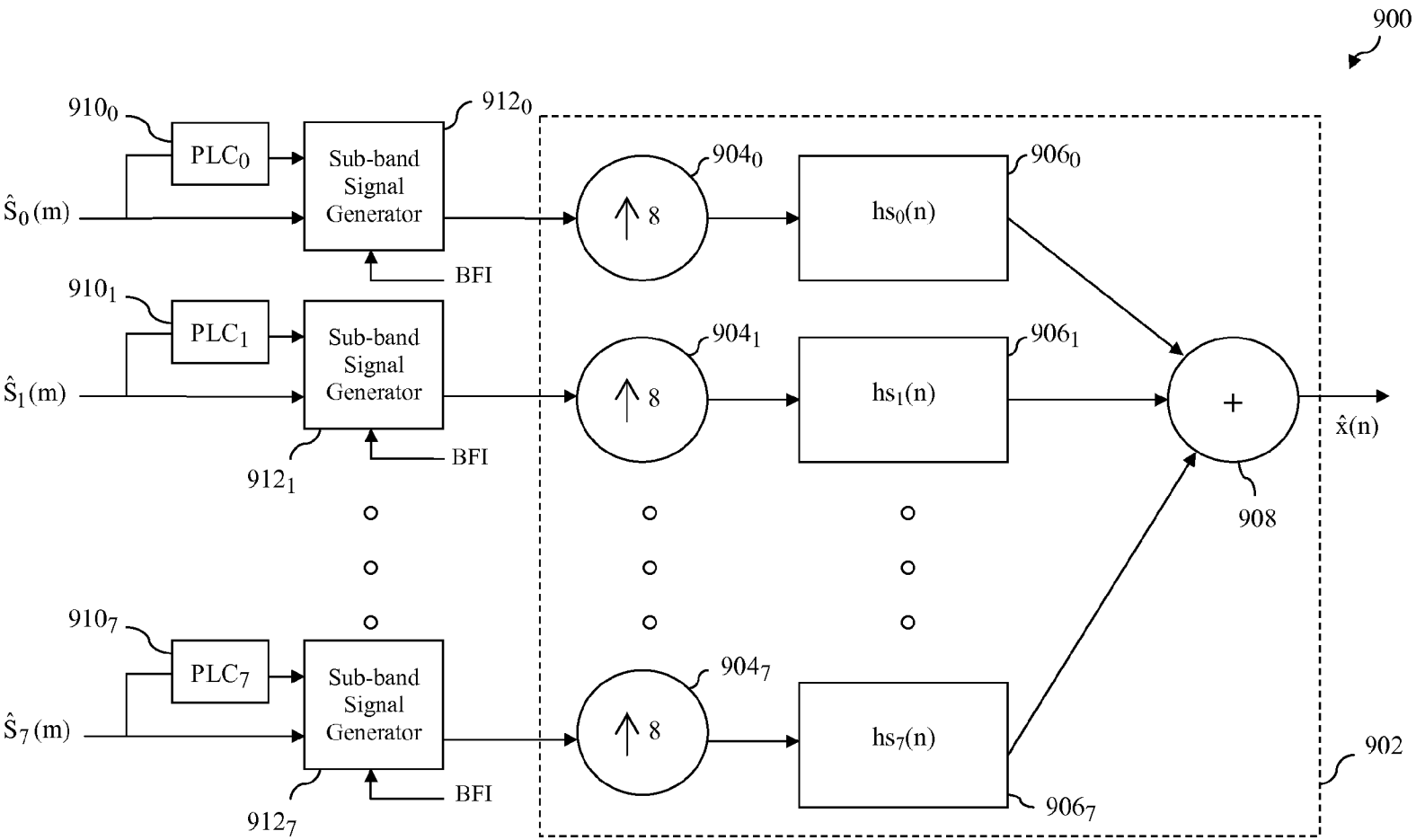
FIG. 9 is a block diagram of a system that implements a sub-band domain based PLC scheme in accordance with an embodiment of the present invention.

FIG. 9 is a block diagram of a system 900 that performs sub-band domain based PLC in accordance with an embodiment of the present invention. As shown in FIG. 9, system 900 includes a synthesis filter bank 902 that comprises a plurality of upsamplers $\mathbf{904}_0$-$\mathbf{904}_7$, a plurality of synthesis filters $\mathbf{906}_0$-$\mathbf{906}_7$, and a combiner 908. Synthesis filter bank 902 operates to combine a plurality of sub-band signals to produce a full-band audio signal $\hat{x}(n)$ in a like manner to synthesis filter bank 412 described above in reference to conventional LC-SBC decoder 400. System 900 further includes a plurality of PLC modules $\mathbf{910}_0$-$\mathbf{910}_7$ each of which operates independently on a corresponding sub-band signal $\hat{S}_0(m)$-$\hat{S}_7(m)$ to produce a corresponding sub-band concealment signal in the presence of errors, as signaled by a BFI. Each of a plurality of sub-band signal generators $\mathbf{912}_0$-$\mathbf{912}_7$ operates to select a sub-band signal that will be input to synthesis filter bank 902 by selectively switching between a sub-band signal $\hat{S}_i(m)$ and a sub-band concealment signal produced by a corresponding PLC module based on the state of the BFI. Note that in some embodiments, during the first good frame after a period of frame loss, each of sub-band signal generators $\mathbf{912}_0$-$\mathbf{912}_7$ generates a sub-band signal that will be input to synthesis filter bank 902 by combining the sub-band signal $\hat{S}^i(m)$ and a sub-band concealment signal that was produced by a corresponding PLC module responsive to the frame loss.

In the foregoing system, each PLC module may operate by computing and maximizing a correlation between previously-received segments of a corresponding sub-band signal $\hat{S}_0(m)$-$\hat{S}_7(m)$ and identifying a lag that maximizes the correlation. This lag can then be used to extrapolate each sub-band signal, thereby generating a concealment signal for each sub-band. In such an embodiment, previously-received portions of the sub-band signals $\hat{S}_0(m)$-$\hat{S}_7(m)$ may be stored in history buffers to facilitate the correlation operation.

Figure 10:
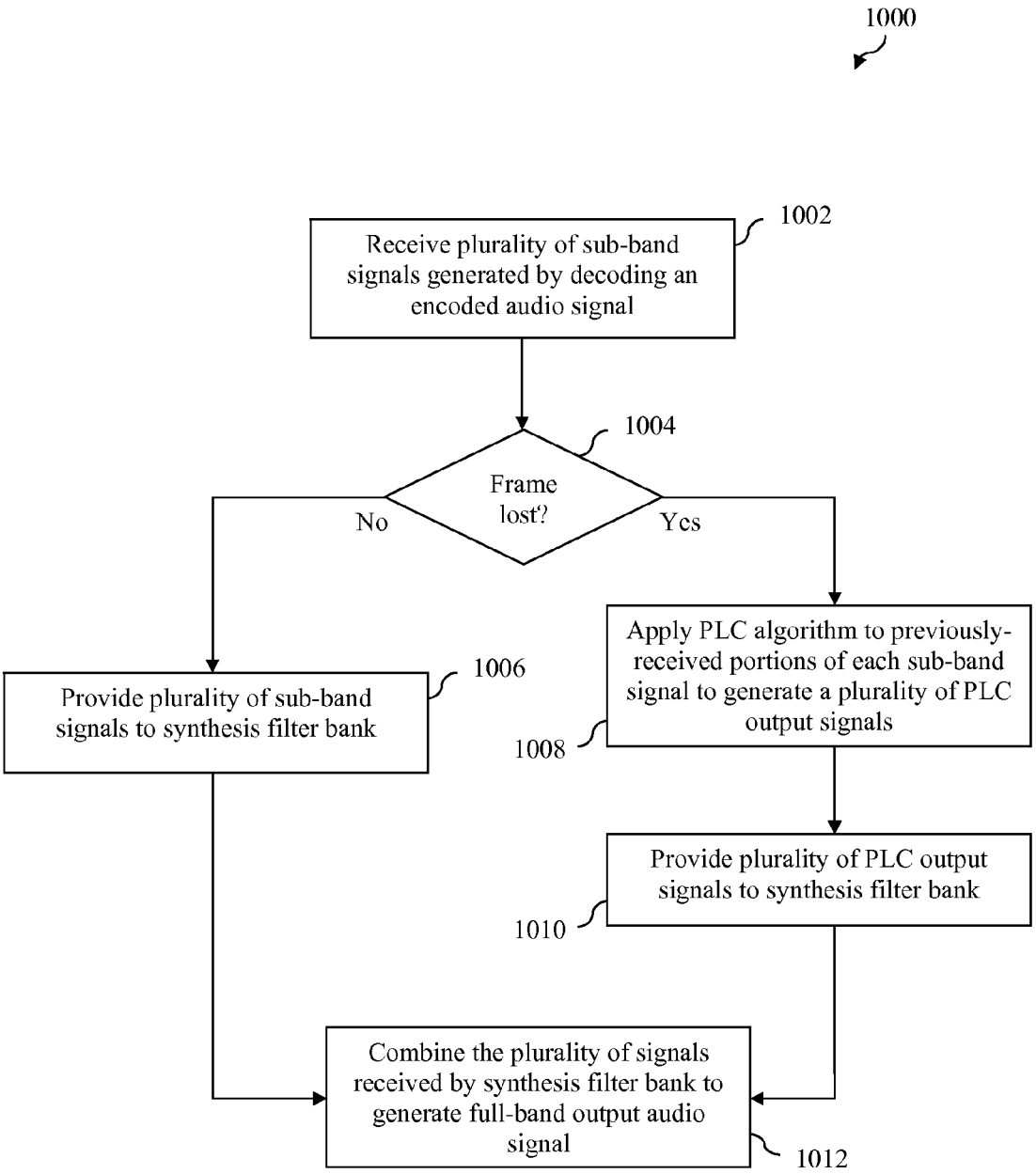
FIG. 10 depicts a flowchart of a method for performing sub-band domain based PLC in accordance with an embodiment of the present invention.

FIG. 10 depicts a flowchart 1000 of a method for performing sub-band domain based PLC in accordance with an embodiment of the present invention. The method of flowchart 1000 may be performed, for example, by system 900 of FIG. 9 although it is not limited to that embodiment.

As shown in FIG. 10, the method of flowchart 1000 begins at step 1002, in which a plurality of sub-band signals $\hat{S}_0(m)$-$\hat{S}_7(m)$ are received, wherein the plurality of sub-band signals were generated by decoding an encoded audio signal. Logic capable of generating these sub-band signals was previously described in reference to conventional LC-SBC decoder 400, as discussed above in reference to FIG. 4.

At decision step 1004, it is determined whether a frame is lost. If it is determined at decision step 1004 that the frame is not lost, then the plurality of sub-band signals are provided to a synthesis filter bank. However, if it is determined at decision step 1004 that the frame is lost, then at step 1008 a PLC algorithm is applied to previously-received portions of each sub-band signal to generate a plurality of PLC output signals and at step 1010, the plurality of PLC output signals are provided to the synthesis filter bank.

At step 1012, the synthesis filter bank combines the plurality of signals received either in step 1006 or step 1010 (depending upon whether or not the frame has been deemed lost) to generate a full-band output audio signal.

Note that in certain embodiments, if it is determined at decision step 1004 that the frame is not lost and the frame is the first good frame after a period of frame loss, then the sub-band signals to be provided to the synthesis filter bank may be generated by combining each of the plurality of sub-band signals $\hat{S}_0(m)$-$\hat{S}_7(m)$ with a previously-generated portion of a corresponding sub-band PLC output signal.

One advantage of a sub-band domain based PLC scheme such as that implemented by system 900 or described in reference to flowchart 1000 is that the memory of the synthesis filter bank does not require any special handling. During a lost frame, the output of the PLC module in each sub-band is fed to the synthesis filter bank just as received sub-band samples are during good frames. At the end of the lost frame, the sub-band buffers in the synthesis filter bank are automatically populated by the last 9 samples of a corresponding PLC module output signal.

However, one disadvantage with a sub-band domain based PLC scheme such as that implemented by system 900 or described in reference to flowchart 1000 is the inherent difficulty in performing concealment on the sub-bands above the lowest-frequency sub-band, which is referred to herein as the first sub-band. As will be appreciated by persons skilled in the relevant art(s), one of the most common approaches to PLC is a technique called periodic waveform extrapolation (PWE). In PWE, the audio signal is assumed to be periodic. A previously-received portion of the audio signal is used to compute the period at which the audio signal is periodic, which is known as the pitch period. The lost portion of the audio signal is then estimated by extrapolating the previously-received portion of the audio signal at the pitch period. For a sub-band domain based packet loss concealment scheme, PWE will work in the first sub-band. However, higher-frequency sub-bands are not guaranteed to be periodic.

To understand this, consider a speech signal with a pitch frequency of 237 Hz. In an 8 sub-band implementation of LC-SBC, the speech signal will be converted into 8 sub-band signals of equal bandwidth. The first sub-band (0-1 kHz) will contain harmonics at 237 Hz, 474 Hz, 711 Hz, and 948 Hz. This signal is periodic with a pitch period of 237 Hz and a PWE-based PLC scheme will work well to conceal the lost frame.

Now consider the second sub-band. It will contain harmonics at 1185 Hz, 1422 Hz, 1659 Hz, and 1896 Hz. This sub-band is modulated down to the baseband (0-1 kHz) by the filter $ha_1(n)$. The harmonics will be modulated to 185 Hz, 422 Hz, 659 Hz, and 896 Hz. The resulting signal is no longer periodic at 237 Hz. In fact, it is not periodic at 185 Hz, or 422 Hz either. It is periodic with a period of 3279 samples (205 ms) or 4.88 Hz. Speech is modeled as stationary over a period no longer than about 30 ms (480 samples at 16 kHz). This implies that the speech would have changed significantly in 205 ms and hence will not be periodic with that period either. As a result, conventional PWE-based PLC cannot accurately model and estimate the sub-band signals beyond the first sub-band. If PWE-based packet loss concealment is used, harmonic distortion will occur.

3. Full-Band Domain Based Packet Loss Concealment with Re-Encoding

Given the disadvantage of harmonic distortion in a sub-band domain based PLC scheme, a full-band domain based PLC scheme may provide better quality if the memory of the synthesis filter bank can be updated appropriately. In accordance with one embodiment of the present invention, to update the synthesis filter bank memory appropriately, the output signal from a PLC module is fed back into the LC-SBC encoder. This technique is referred to herein as "re-encoding." A form of re-encoding has been used for the ITU-T G.722 speech codec ("G.722."). See, M. Serizawa and Y. Nozawa, "A Packet Loss Concealment Method Using Pitch Waveform Repetition and Internal State Update on the Decoded Speech for the Sub-Band ADPCM Wideband Speech Codec," Proc. ICASSP, pp. 68-71, May 2002 and J. Thyssen, R. Zopf, J.-H. Chen and N. Shetty, "A Candidate for the ITU-T G.722 Packet Loss Concealment Standard," Proc. IEEE Int'l Conf. Acoustics, Speech, and Signal Processing, vol. 4, pp. IV-549-IV-552, April 2007. In the case of G.722, the state of the encoder memory is identical to that of the decoder memory when the encoder and decoder are synchronized. Hence, when using re-encoding in conjunction with G.722, the state of the decoder memory after frame loss is updated with the state of the encoder memory that is generated by re-encoding the concealment signal.

An embodiment of the present invention is premised on the observation that the re-encoding procedure of G.722 cannot be used in conjunction with LC-SBC. In the case of LC-SBC, the sub-band signals generated by the encoder make up the decoder memory (instead of the encoder memory itself). A block diagram of a system 1100 that performs full-band domain based PLC by using a modified re-encoding scheme for LC-SBC is shown in FIG. 11.

Figure 11:
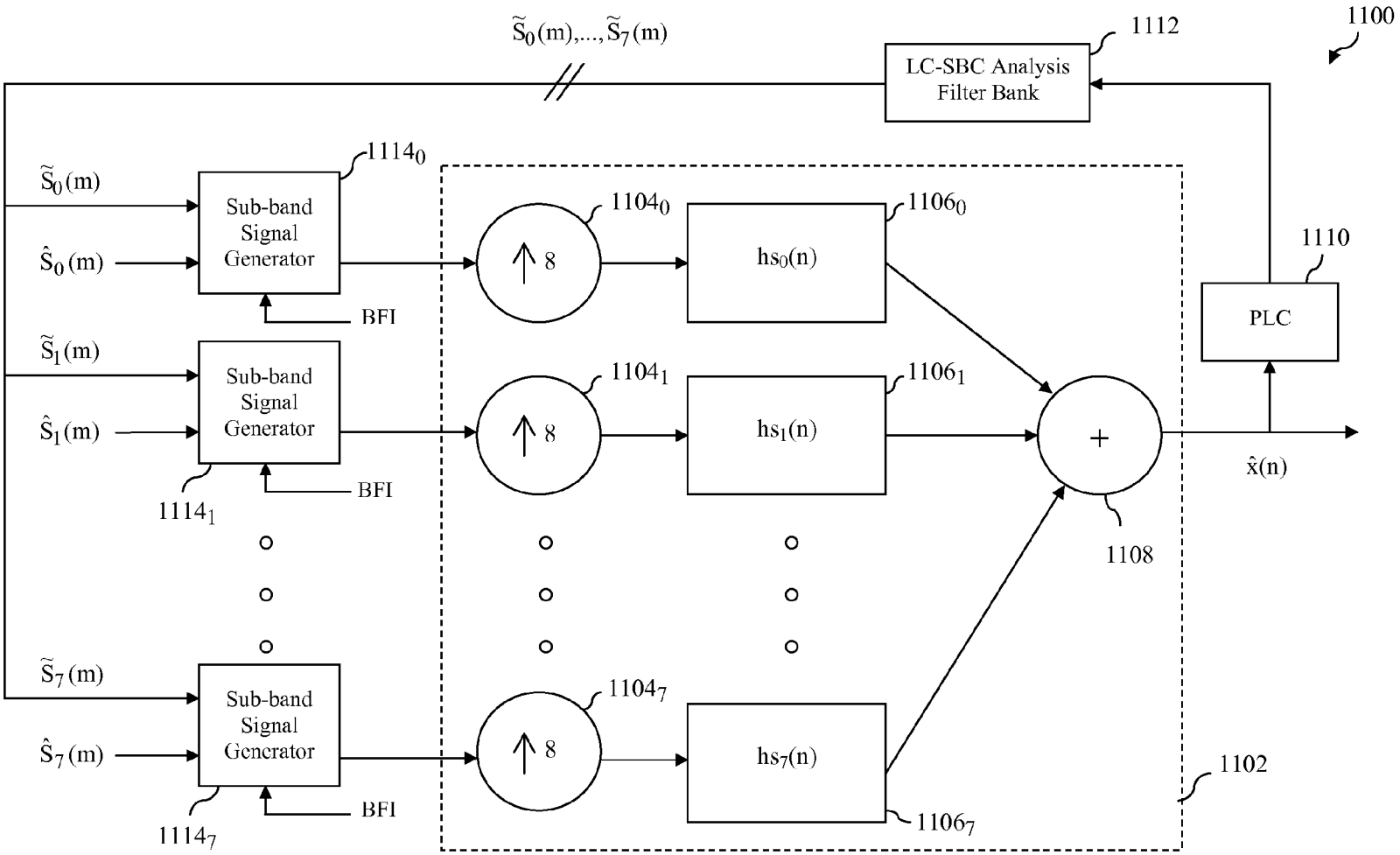
FIG. 11 is a block diagram of a system that performs full-band domain based PLC by using re-encoding to update a synthesis filter bank memory in accordance with an embodiment of the present invention.

As shown in FIG. 11, system 1100 includes a synthesis filter bank 1102 that comprises a plurality of upsamplers $\mathbf{1104}_0$-$\mathbf{1104}_7$, a plurality of synthesis filters $\mathbf{1106}_0$-$\mathbf{1106}_7$, and a combiner 1108. Synthesis filter bank 1102 operates to combine a plurality of sub-band signals to produce a full-band audio signal $\hat{x}(n)$ in a like manner to synthesis filter bank 412 described above in reference to conventional LC-SBC decoder 400. System 1100 further includes a PLC module 1110 that uses the full-band signal $\hat{x}(n)$ as input to produce a full-band concealment signal. The full-band concealment signal generated by PLC module 1110 is fed to an LC-SBC analysis filter bank 1112 which operates in a like manner to analysis filter bank 102 described above in reference to conventional LC-SBC encoder 100 to convert the signal into un-quantized sub-band signals $\tilde{S}_0(m)$-$\tilde{S}_7(m)$. A BFI is then used to drive a plurality of sub-band signal generators $\mathbf{1114}_0$-$\mathbf{1114}_7$, each of which operates to select a sub-band signal that will be input to synthesis filter bank 1102 by switching between a received sub-band signal $\hat{S}_i(m)$ during good frames and a PLC-generated sub-band signal $\tilde{S}_i(m)$ during bad frames. Note that this procedure must take into account the delay in the analysis and synthesis filter banks. The PLC-generated signal must thus be extended beyond the end of the lost frame by this delay in order to properly time-align $\tilde{S}_i(m)$. In the case of LC-SBC with 8 sub-bands and 128 samples per frame, the delay is approximately 72-73 samples depending on the exact codec configuration.

In one embodiment, to avoid sharp discontinuities after a period of packet loss, during the first good frame after a period of packet loss, the ful-band audio output signal is generated by combining the full-band audio signal generated using PLC which is extended beyond the end of the lost frame and the full-band audio signal generated through normal decoding.

The combination may be achieved for example by performing an overlap-add between segments of the two audio signals.

Note that in an alternate implementation of system 1100, the output of PLC module 1110 may be fed to a full LC-SBC encoder rather than to LC-SBC analysis filter bank 1112 such that quantized sub-band signals can be generated. However, this is more complex and only adds degradation due to the quantization of the sub-band signals.

Figure 12:
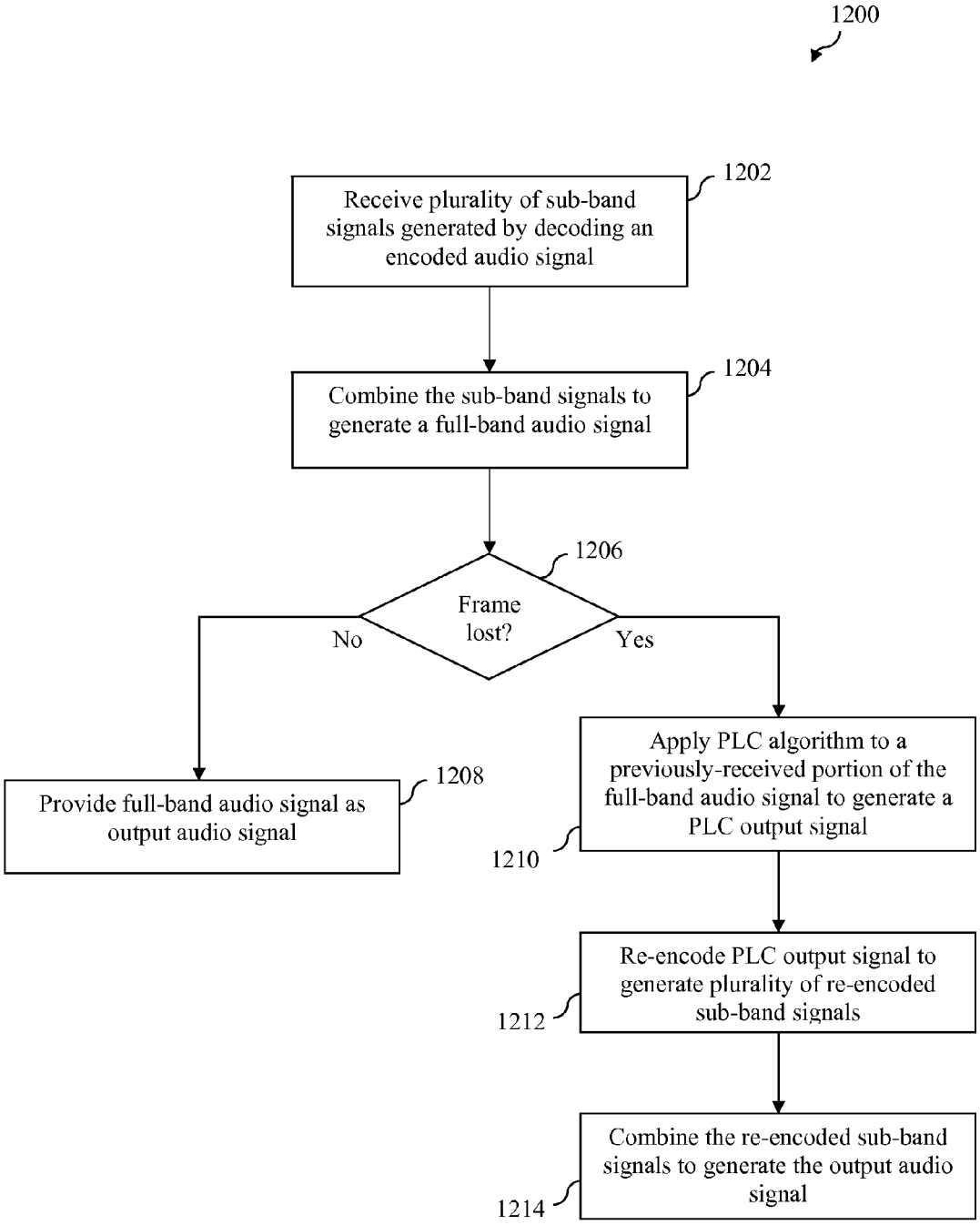
FIG. 12 depicts a flowchart of a method for performing full-band domain based PLC by using a modified re-encoding scheme for LC-SBC in accordance with an embodiment of the present invention.

FIG. 12 depicts a flowchart 1200 of a method for performing full-band domain based PLC by using a modified re-encoding scheme for LC-SBC in accordance with an embodiment of the present invention. The method of flowchart 1200 may be performed, for example, by system 1100 of FIG. 11 although it is not limited to that embodiment.

As shown in FIG. 12, the method of flowchart 1200 begins at step 1202, in which a plurality of sub-band signals $\hat{S}_0(m)$-$\hat{S}_7(m)$ are received, wherein the plurality of sub-band signals were generated by decoding an encoded audio signal. Logic capable of generating these sub-band signals was previously described in reference to conventional LC-SBC decoder 400, as discussed above in reference to FIG. 4.

At step 1204, the sub-band signals received at step 1202 are combined to generate a full-band audio signal.

At decision step 1206, it is determined whether a frame is lost. If it is determined at decision step 1206 that the frame is not lost, then the full-band audio signal is provided as an output audio signal. However, if it is determined at decision step 1206 that the frame is lost, then at step 1210 a PLC algorithm is applied to a previously-received portion of the full-band audio signal to generate a PLC output signal. At step 1212, the PLC output signal is re-encoded to generate a plurality of re-encoded sub-band signals. At step 1214, the re-encoded sub-band signals are combined to generate the output audio signal.

As noted above, in one embodiment, if the frame is the first good frame after a period of packet loss, the output audio signal is generated by combining the PLC output signal which is extended beyond the end of the lost frame and the full-band audio signal generated through normal decoding. The combination may be achieved for example by performing an overlap-add between segments of the two audio signals.

4. Enhanced Packet Loss Concealment Utilizing Synthesis Filter Bank Zero-Input Response As described in the preceding sub-section, the PLC approach implemented by system 1100 addresses the issue of updating the memory of the synthesis filter bank after frame loss. In one implementation, PLC module 1110 in system 1100 uses the full-band audio signal $\hat{x}(n)$ generated during good frames to perform PWE-based PLC in the bad frames.

Figure 8:
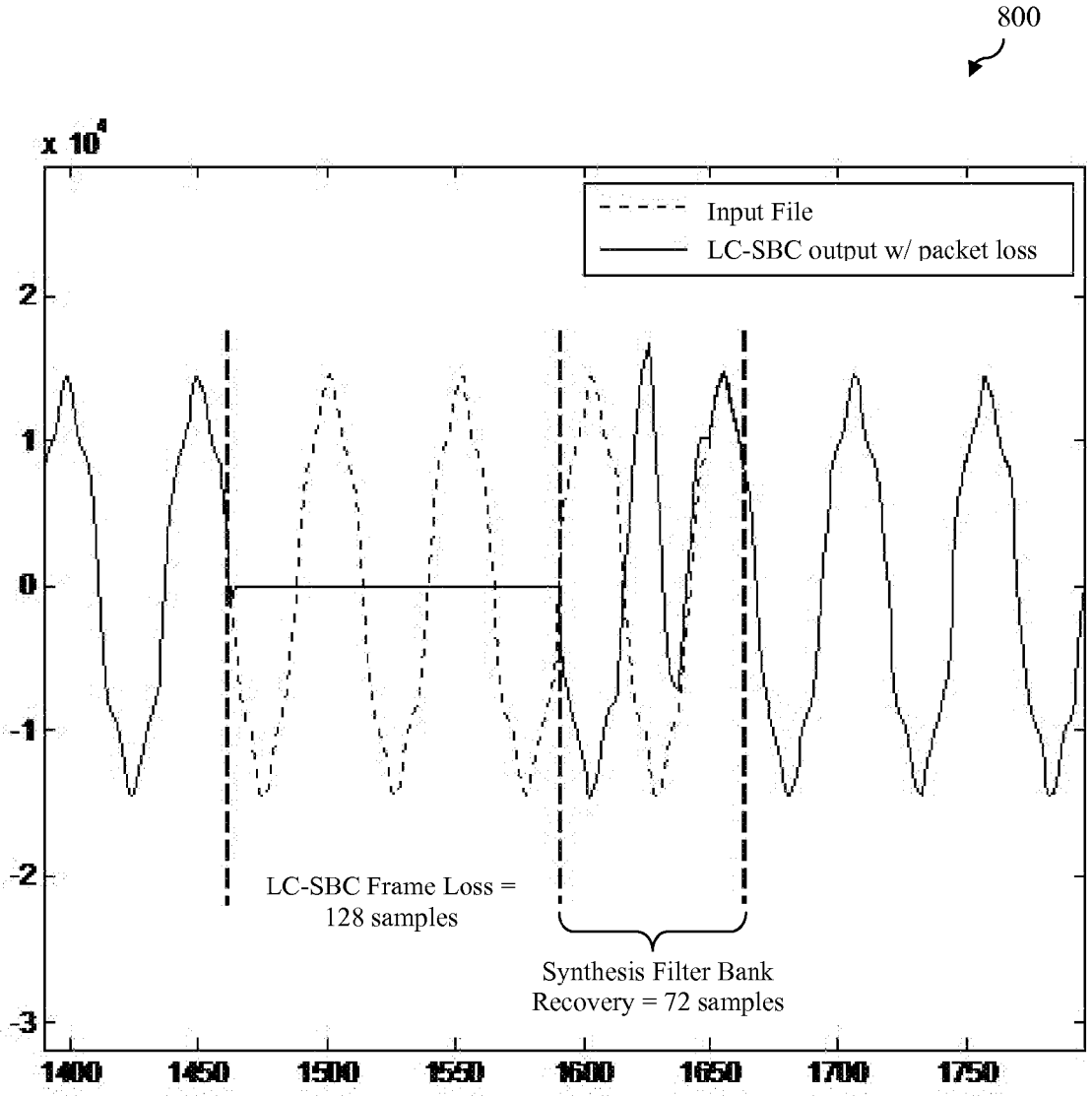
FIG. 8 is a graph showing the effect of synthesis re-convergence after packet loss at the output of an LC-SBC decoder.

However, as mentioned previously, there is a delay in the synthesis filter bank. Graph 800 of FIG. 8 illustrated how the synthesis filter bank takes time to re-converge after frame loss. The same buffers in the synthesis filter bank that cause this delay can be exploited in the first bad frame in a period of frame loss to offset the re-convergence in the first good frame after the period of frame loss. Just as the samples $\hat{S}_i(m)$, m=7, . . . , 15 from the last bad frame are not available in the first good frame as discussed above in Section C.1, the samples $\hat{S}_i(m)$, m=7, . . . , 15 from the last good frame are still buffered in the synthesis filter bank at the start of the first bad frame. The full-band 16 kHz signal produced by these buffered sub-band samples is the zero-input response of the synthesis filter bank. It is obtained by setting $\hat{S}_i(m)=0$, m=0, . . . , 8; i=0, . . . , 7 to produce 72 full-band 16 kHz samples. The resulting signal may be denoted $x_{ZIR}(n)$. Since this signal has passed through the synthesis filter bank, it has been filtered by modulated versions of the prototype low-pass filter p(n) depicted in FIG. 3. As such, not all of the 72 samples will be usable. However, the energy in p(n) does not ramp up for approximately 30-40 samples, indicating that $$x_{ZIR}(n)\approx\hat{x}(n)\ n=0,\ldots,\approx 30\text{-}40. \tag{4}$$

Now consider the re-convergence issue in the first good frame after frame loss, as illustrated in FIG. 8. If the memory of the synthesis filter bank is set to zero during a lost frame, then the output of the synthesis filter bank in the first good frame after a period of frame loss will be entirely attributable to the sub-band signals received in that first good frame. The contribution to the output signal $\hat{x}(n)$ from the synthesis filter memory will be zero. This signal is commonly referred to as the zero-state response of a filter. Denote $x_{ZSR}(n)$ the signal obtained in the first good frame by setting the filter memory to zero. In a like manner to the ZIR signal mentioned above, this ZSR signal will ramp up as the received sub-band signals are passed through the synthesis filter bank and:

$$x_{ZSR}(n)\approx\hat{x}(n)\ n=\approx 40\text{-}50,\ldots,71 \tag{5}$$

$$x_{ZSR}(n)=\hat{x}(n)\ n=72,\ldots,127. \tag{6}$$

Figure 13:
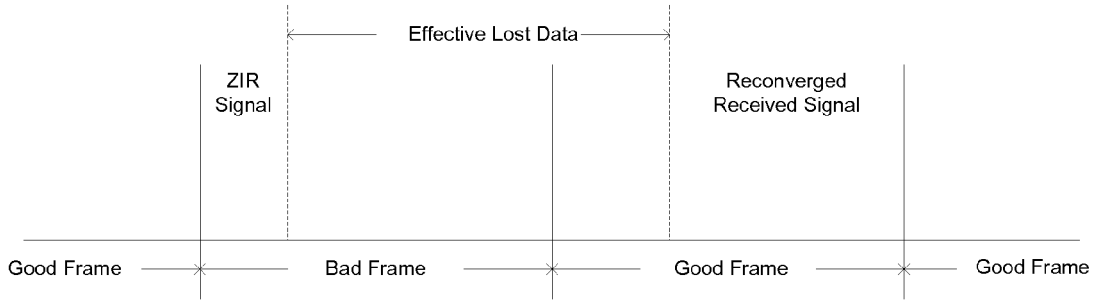
FIG. 13 is a diagram that illustrates the effective location of lost data when using a zero-input response of a synthesis filter bank to generate a PLC signal in accordance with an embodiment of the present invention.

Re-convergence time was mentioned as a disadvantage of the full-band domain based PLC approach described above as compared to the sub-band domain based PLC approach described above. However, the samples lost during re-convergence in the first good frame may be almost completely compensated for by the samples gained using $x_{ZIR}(n)$ in the first bad frame. This has the effect of essentially shifting the lost frame by the delay of the synthesis filter bank as illustrated in FIG. 13. A PLC system and method for LC-SBC that takes advantage of this will be described in the following sub-section.

5. Full-Band Domain Based Packet Loss Concealment with Low-Complexity Configuration By re-encoding the signal generated by PLC module 1110 and then feeding the sub-band signals $\tilde{S}_i(m)$ through synthesis filter bank 1102, system 1100 described above in reference to FIG. 11 uses the windowed nature of synthesis filter bank 1102 to transition from a normally-decoded signal associated with a last good frame before a period of frame loss to a concealment signal and then back to a normally-decoded signal associated with a first good frame after the period of frame loss. However, this comes at the complexity of implementing both synthesis filter bank 1102 and analysis filter bank 1112. In an alternate embodiment, an overlap-add in the 16 kHz domain can be used to transition between the last good frame and the concealment signal and then to the signal received in the first good frame. This avoids re-encoding, and results in a more simplified system.

Figure 14:
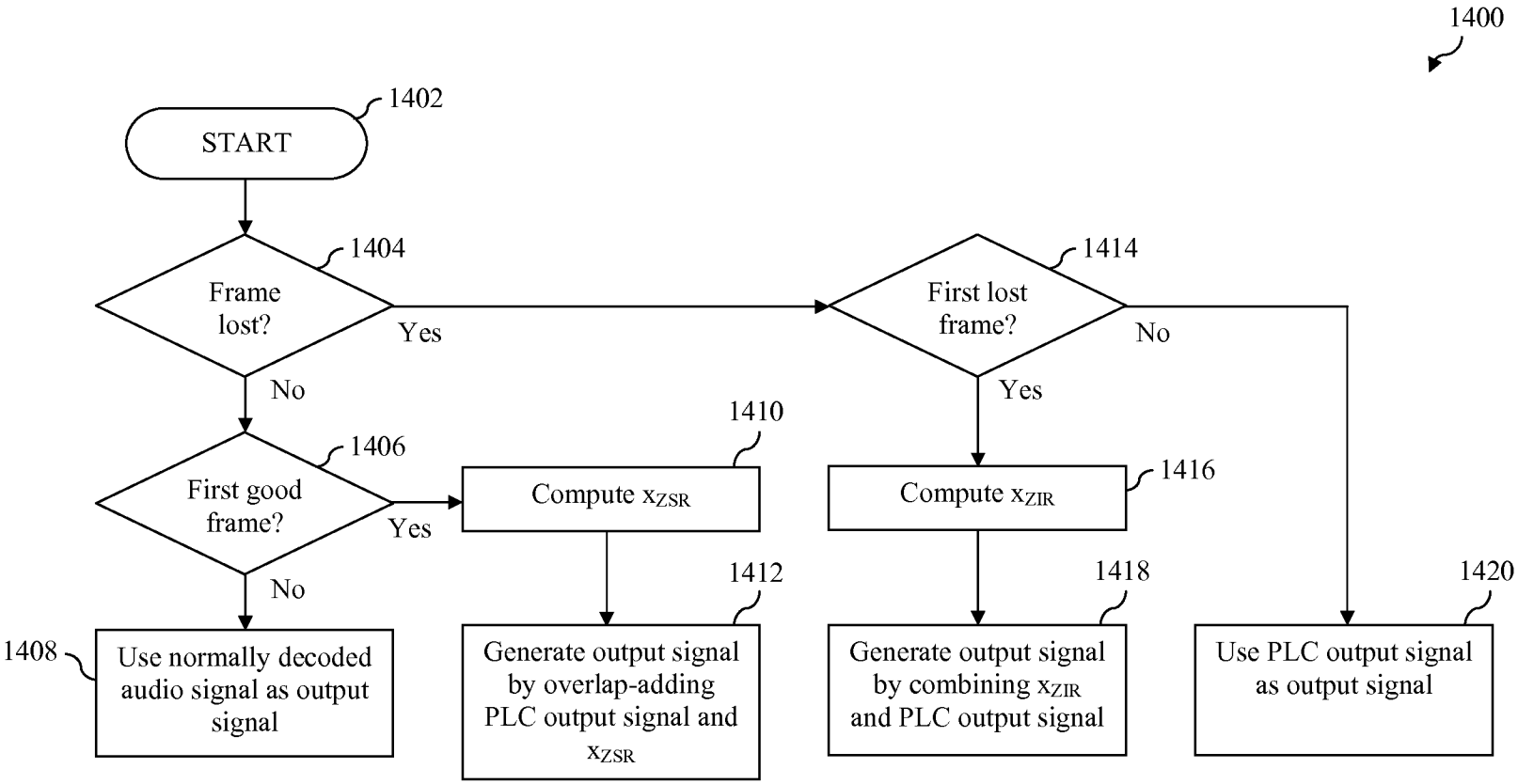
FIG. 14 depicts a flowchart of method for performing a low-complexity full-band-based PLC algorithm in accordance with an embodiment of the present invention.

This method is illustrated by flowchart 1400 of FIG. 14. The method of flowchart 1400 may be implemented, for example, by PLC logic that is coupled to receive the full-band audio signal $\hat{x}(n)$ generated by an LC-SBC decoder. The method illustrates the processing of a single frame of an encoded audio signal.

As shown in FIG. 14, the method of flowchart 1400 begins at node 1402, denoted "start." Control then flows to decision step 1404, in which it is determined whether or not a frame has been lost. If the frame has not been lost, then control flows to decision step 1406, in which it is determined whether the frame is the first good frame after a period of frame loss. If the frame is not the first good frame after a period of frame loss, then control flows to step 1408 in which the normally decoded full-band audio signal $\hat{x}(n)$ is provided as the output signal.

Returning now to decision step 1404, if it is determined during that step that the frame is lost, then control flows to decision step 1414, in which it is determined whether the lost frame is the first lost frame in a period of frame loss. If the lost frame is not the first lost frame in a period of frame loss, then control flows to step 1420 in which a PLC output signal generated by a PLC module that operates on previously-received portions of the full-band audio signal $\hat{x}(n)$ is provided as the output signal. However, if the lost frame is the first lost frame in a period of frame loss, then control flows to step 1416, in which $x_{ZIR}(n)$ is computed in the manner described above in sub-section C.4. At step 1418, the output audio signal is generated by combining a segment of $x_{ZIR}(n)$ and a segment of the PLC output signal generated by the PLC module.

Figure 15:
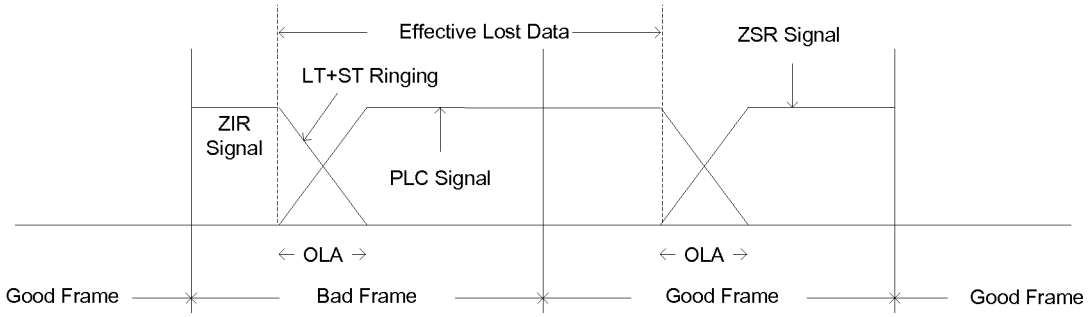
FIG. 15 is a diagram that illustrates frames generated using a low-complexity full-band-based PLC algorithm in accordance with an embodiment of the present invention.

Note that in reference to steps 1418 and 1420 any PLC algorithm may be used to generate the PLC output signal. For example, a low-complexity PLC algorithm described in commonly-owned, co-pending U.S. patent application Ser. No. 12/147,781 to Juin-Hwey Chen entitled "Low-Complexity Packet Loss Concealment" and filed on Jun. 27, 2008 (the entirety of which is incorporated by reference herein), may be modified for 16 kHz input and used. As shown in FIG. 15, during the first bad frame, the $x_{ZIR}(n)$ signal is treated as original received signal, thus reducing the effective length of the bad frame. Only the linear region (with only minor windowing due to the front tail of the sub-band filters) of $x_{ZIR}(n)$ should be used. For the specified configuration of LC-SBC, a length of 30 samples may be used. As specified in the aforementioned U.S. patent application Ser. No. 12/147,781, an overlap-add between the ringing of short-term and long-term prediction filters and the PLC output signal may also be performed during the first bad frame to avoid discontinuities. This is also reflected in FIG. 15.

It is noted that the incorporation of the linear region of $x_{ZIR}(n)$ into the PLC computation described by U.S. patent application Ser. No. 12/147,781 will have the advantageous effect of improving pitch estimation, LPC analysis, ringing, etc. This is because the linear region of $x_{ZIR}(n)$ provides samples that are closer in time to the frame loss to include in the analysis window for computing these parameters.

Returning now to decision step 1406, if it is determined during that step that the frame is the first good frame after a period of frame loss, then control flows to step 1410, during which $x_{ZSR}(n)$ is computed in the manner described above in sub-section C.4. At step 1412, the output signal is generated by performing an overlap add between a segment of the PLC output signal and a segment of $x_{ZSR}(n)$. The PLC output signal should preferably be extended beyond the frame boundary to the point where $x_{ZSR}(n)$ has reconverged enough to be usable in the overlap-add. For the exemplary LC-SBC configuration specified in this application, the PLC output signal is preferably extended by 38 samples and the overlap-add length is preferably 40 samples. FIG. 15 also illustrates the overlap-add of the PLC output signal and $x_{ZSR}(n)$ in the first good frame.

The use of $x_{ZSR}(n)$ in the first good frame advantageously avoids re-encoding and thus significantly reduces complexity.

In the foregoing method, the use of overlap-add operations instead of a synthesis filter bank to combine received signals and PLC signals significantly reduces complexity.

6. Packet Loss Concealment Performance

Figure 16:
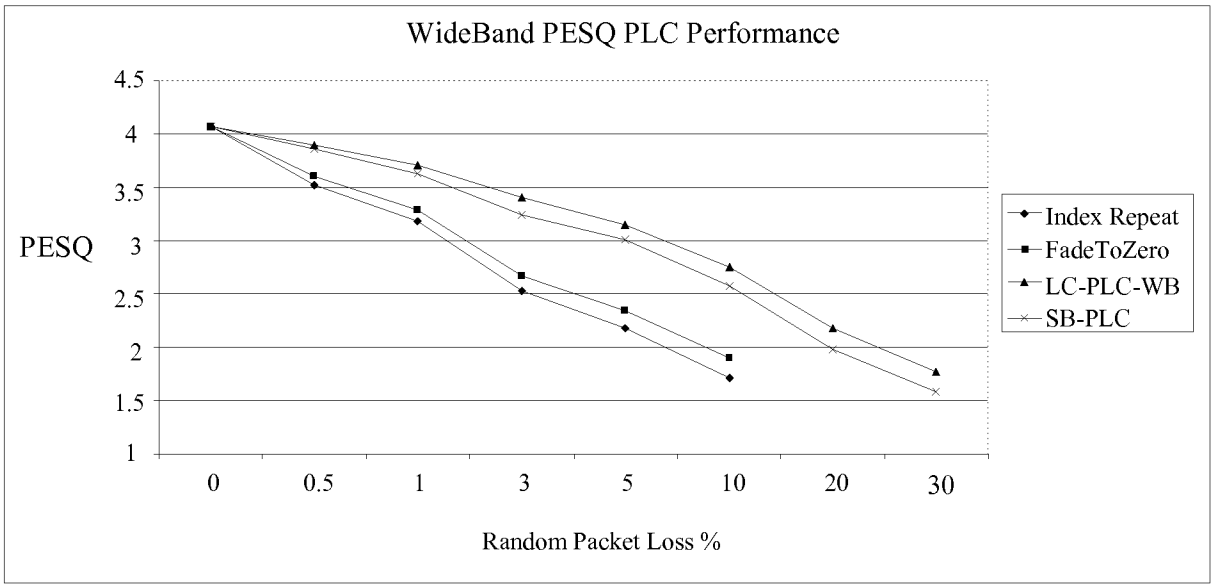
FIG. 16 is a graph that illustrates the performance of various PLC schemes including full-band domain based and sub-band domain based PLC schemes in accordance with embodiments of the present invention.

The system presented in Section C.5 ("LC-PLC-WB") is compared against the sub-band-based PLC ("SB-PLC") described in Section C.2. For reference, two other PLC systems are also compared: (1) "Index Repeat," which simply repeats the sub-band values from the last good frame, and (2) "Fade To Zero," which sets the sub-band values to zero during frame loss. The results are shown in FIG. 16. In FIG. 16, performance is measured in terms of a Perceptual Evaluation of Speech Quality (PESQ) score versus random packet loss percentage. As can be seen, the LC-PLC-WB significantly out-performs the sub-band system SB-PLC.

D. Example Computer System Implementations

Figure 17:
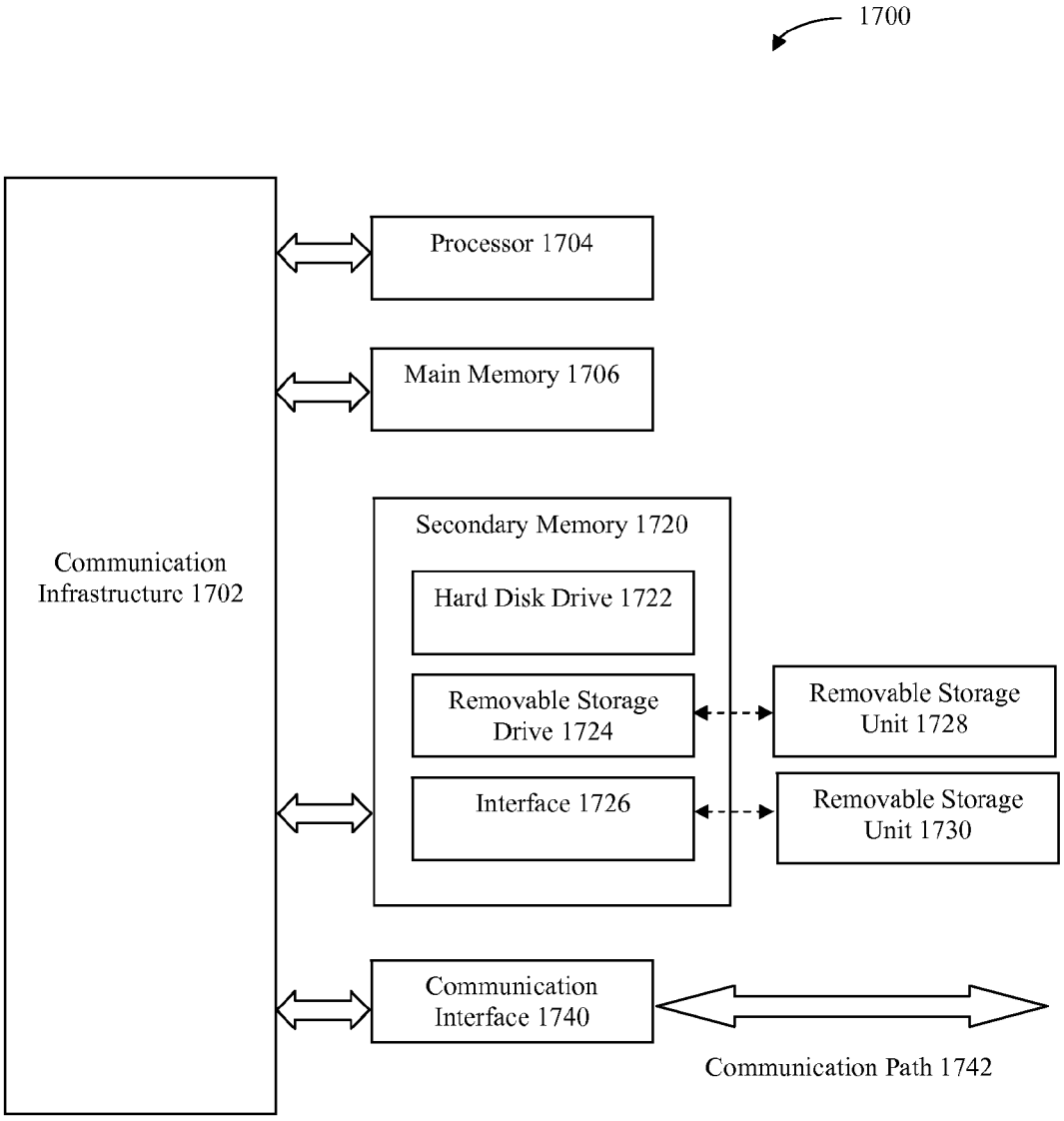
FIG. 17 is a block diagram of an example computer system that may be used to implement aspects of the present invention.

The following description of a general purpose computer system is provided for the sake of completeness. The present invention can be implemented in hardware, or as a combination of software and hardware. Consequently, the invention may be implemented in the environment of a computer system or other processing system. An example of such a computer system 1700 is shown in FIG. 17.

Computer system 1700 includes one or more processors, such as processor 1704. Processor 1704 can be a special purpose or a general purpose digital signal processor. Processor 1704 is connected to a communication infrastructure 1702 (for example, a bus or network). Various software implementations are described in terms of this exemplary computer system. After reading this description, it will become apparent to a person skilled in the relevant art(s) how to implement the invention using other computer systems and/or computer architectures.

Computer system 1700 also includes a main memory 1706, preferably random access memory (RAM), and may also include a secondary memory 1720. Secondary memory 1720 may include, for example, a hard disk drive 1722 and/or a removable storage drive 1724, representing a floppy disk drive, a magnetic tape drive, an optical disk drive, or the like. Removable storage drive 1724 reads from and/or writes to a removable storage unit 1728 in a well known manner. Removable storage unit 1728 represents a floppy disk, magnetic tape, optical disk, or the like, which is read by and written to by removable storage drive 1724. As will be appreciated by persons skilled in the relevant art(s), removable storage unit 1728 includes a computer usable storage medium having stored therein computer software and/or data.

In alternative implementations, secondary memory 1720 may include other similar means for allowing computer programs or other instructions to be loaded into computer system 1700. Such means may include, for example, a removable storage unit 1730 and an interface 1726. Examples of such means may include a program cartridge and cartridge interface (such as that found in video game devices), a removable memory chip (such as an EPROM, or PROM) and associated socket, and other removable storage units 1730 and interfaces 1726 which allow software and data to be transferred from removable storage unit 1730 to computer system 1700.

Computer system 1700 may also include a communications interface 1740. Communications interface 1740 allows software and data to be transferred between computer system 1700 and external devices. Examples of communications interface 1740 may include a modem, a network interface (such as an Ethernet card), a communications port, a PCMCIA slot and card, etc. Software and data transferred via communications interface 1740 are in the form of signals which may be electronic, electromagnetic, optical, or other signals capable of being received by communications interface 1740. These signals are provided to communications interface 1740 via a communications path 1742. Communications path 1742 carries signals and may be implemented using wire or cable, fiber optics, a phone line, a cellular phone link, an RF link and other communications channels.

As used herein, the terms "computer program medium" and "computer usable medium" are used to generally refer to media such as removable storage units 1728 and 1730 or a hard disk installed in hard disk drive 1722. These computer program products are means for providing software to computer system 1700.

Computer programs (also called computer control logic) are stored in main memory 1706 and/or secondary memory 1720. Computer programs may also be received via communications interface 1740. Such computer programs, when executed, enable the computer system 1700 to implement the present invention as discussed herein. In particular, the computer programs, when executed, enable processor 1700 to implement the processes of the present invention, such as any of the methods described herein. Accordingly, such computer programs represent controllers of the computer system 1700. Where the invention is implemented using software, the software may be stored in a computer program product and loaded into computer system 1700 using removable storage drive 1724, interface 1726, or communications interface 1740.

In another embodiment, features of the invention are implemented primarily in hardware using, for example, hardware components such as application-specific integrated circuits (ASICs) and gate arrays. Implementation of a hardware state machine so as to perform the functions described herein will also be apparent to persons skilled in the relevant art(s).

E. Conclusion

While various embodiments of the present invention have been described above, it should be understood that they have been presented by way of example, and not limitation. It will be apparent to persons skilled in the relevant art that various changes in form and detail can be made therein without departing from the spirit and scope of the invention.

The present invention has been described above with the aid of functional building blocks and method steps illustrating the performance of specified functions and relationships thereof. The boundaries of these functional building blocks and method steps have been arbitrarily defined herein for the convenience of the description. Alternate boundaries can be defined so long as the specified functions and relationships thereof are appropriately performed. Any such alternate boundaries are thus within the scope and spirit of the claimed invention. One skilled in the art will recognize that these functional building blocks can be implemented by discrete components, application specific integrated circuits, processors executing appropriate software and the like or any combination thereof. Thus, the breadth and scope of the present invention should not be limited by any of the above-described exemplary embodiments, but should be defined only in accordance with the following claims and their equivalents.

What is claimed is:

1. A method for performing packet loss concealment (PLC) in a sub-band codec, comprising:

receiving a plurality of sub-band signals generated by decoding an encoded audio signal;

combining the sub-band signals to generate a full-band audio signal; and responsive to determining that a frame of the encoded audio signal is lost:

applying a PLC algorithm to the full-band audio signal to generate a PLC output signal; and generating a full-band output audio signal based on the PLC output signal, wherein generating the full-band output audio signal based on the PLC output signal comprises processing the PLC output signal in an analysis filter bank to produce a plurality of re-encoded sub-band signals and combining the re-encoded sub-band signals to generate the full-band output audio signal, wherein at least one of the receiving, combining, applying and generating steps is performed by a processor or an integrated circuit.

2. The method of claim 1, wherein the sub-band codec is one of a Low-Complexity Sub-band Coding (LC-SBC) codec that is implemented in accordance with a Bluetooth protocol, an MPEG-1 Audio Layer 3 (MP3) codec, an Advanced Audio Coding (AAC) codec or a Dolby AC-3 codec.

3. The method of claim 1, wherein applying a PLC algorithm to the full-band audio signal includes applying periodic waveform extrapolation to the full-band audio signal.

4. The method of claim 1, further comprising:

responsive to determining that a frame of the encoded audio signal represents a first good frame after a period of packet loss:

generating the output audio signal by combining a segment of the PLC output signal and a segment of a full-band audio signal generated by decoding the first good frame.

5. A system, comprising:

a synthesis filter bank configured to combine a plurality of sub-band signals to generate a full-band output audio signal;

a packet loss concealment (PLC) module configured to apply a PLC algorithm to the full-band output audio signal to generate a PLC output signal;

an analysis filter bank configured to decompose the PLC output signal into a plurality of re-encoded sub-band signals;

logic configured to generate a plurality of decoded sub-band signals by decoding an encoded audio signal; and a plurality of sub-band signal generators, each of which is configured to select between a corresponding decoded sub-band signal and a corresponding re-encoded sub-band signal for provision to the synthesis filter bank.

6. The system of claim 5, wherein each sub-band signal generator is configured to select between a corresponding decoded sub-band signal and a corresponding re-encoded sub-band signal for provision to the synthesis filter bank based on a state of a bad frame indicator.

7. The system of claim 5, wherein the PLC module is configured to apply the PLC algorithm to the full-band output audio signal by applying periodic waveform extrapolation to the full-band output audio signal.

8. The method of claim 1, wherein the re-encoded sub-band signals are un-quantized sub-band signals.

9. The method of claim 1, further comprising:

responsive to determining that the frame of the encoded audio signal is not lost:

generating a full-band output audio signal based on the full-band audio signal.

10. The method of claim 4, wherein combining the segment of the PLC output signal and the segment of the full-band audio signal generated by decoding the first good frame comprises overlap-adding the segment of the PLC output signal and the segment of the full-band audio signal generated by decoding the first good frame.

11. The system of claim 5, wherein the plurality of re-encoded sub-band signals are a plurality of un-quantized sub-band signals.

12. The system of claim 5, wherein each of the plurality of sub-band signal generators are configured to select the corresponding decoded sub-band signal for provision to the synthesis filter bank in response to a determination that a good frame of an encoded audio signal from which the plurality of sub-band signals are decoded is received.

13. The system of claim 12, wherein each of the plurality of sub-band signal generators are configured to select the corresponding re-encoded sub-band signal for provision to the synthesis filter bank in response to a determination that a frame of the encoded audio signal is lost.

14. A computer readable storage device having computer program instructions embodied in said computer readable storage medium for enabling a processor to perform packet loss concealment (PLC) in a sub-band codec, the computer program instructions including instructions executable to perform operations comprising:

receiving a plurality of sub-band signals generated by decoding an encoded audio signal;

combining the sub-band signals to generate a full-band audio signal; and responsive to determining that a frame of the encoded audio signal is lost:

applying a PLC algorithm to the full-band audio signal to generate a PLC output signal; and generating a full-band output audio signal based on the PLC output signal, wherein generating the full-band output audio signal based on the PLC output signal comprises processing the PLC output signal in an analysis filter bank to produce a plurality of re-encoded sub-band signals and combining the re-encoded sub-band signals to generate the full-band output audio signal.

15. The computer readable storage device of claim 14, wherein the sub-band codec is one of a Low-Complexity Sub-band Coding (LC-SBC) codec that is implemented in accordance with a Bluetooth protocol, an MPEG-1 Audio Layer 3 (MP3) codec, an Advanced Audio Coding (AAC) codec or a Dolby AC-3 codec.

16. The computer readable storage device of claim 14, wherein applying a PLC algorithm to the full-band audio signal includes applying periodic waveform extrapolation to the full-band audio signal.

17. The computer readable storage device of claim 14, wherein the operations further comprise:

responsive to determining that a frame of the encoded audio signal represents a first good frame after a period of packet loss:

generating the output audio signal by combining a segment of the PLC output signal and a segment of a full-band audio signal generated by decoding the first good frame.

18. The computer readable storage device of claim 14, wherein the re-encoded sub-band signals are un-quantized sub-band signals.

19. The computer readable storage device of claim 14, wherein the operations further comprise:

responsive to determining that the frame of the encoded audio signal is not lost:

generating a full-band output audio signal based on the full-band audio signal.

20. The computer readable storage device of claim 17, wherein combining the segment of the PLC output signal and the segment of the full-band audio signal generated by decoding the first good frame comprises overlap-adding the segment of the PLC output signal and the segment of the full-band audio signal generated by decoding the first good frame.

* * * * *